US009478228B2

(12) United States Patent
Oomen et al.

(10) Patent No.: US 9,478,228 B2
(45) Date of Patent: Oct. 25, 2016

(54) ENCODING AND DECODING OF AUDIO SIGNALS

(71) Applicant: KONINKLIJKE PHILIPS N.V., Eindhoven (NL)

(72) Inventors: Arnoldus Werner Johannes Oomen, Eindhoven (NL); Jeroen Gerardus Henricus Koppens, Nederweert (NL); Erik Gosuinus Petrus Schuijers, Oss (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/413,234

(22) PCT Filed: Jul. 9, 2013

(86) PCT No.: PCT/IB2013/055628

§ 371 (c)(1),
(2) Date: Jan. 7, 2015

(87) PCT Pub. No.: WO2014/009878

PCT Pub. Date: Jan. 16, 2014

(65) Prior Publication Data

US 2015/0142453 A1 May 21, 2015

Related U.S. Application Data

(60) Provisional application No. 61/669,197, filed on Jul. 9, 2012.

(51) Int. Cl.
*G10L 19/26* (2013.01)
*G10L 19/20* (2013.01)

(Continued)

(52) U.S. Cl.
CPC ..... *G10L 19/265* (2013.01); *G10L 19/008* (2013.01); *G10L 19/18* (2013.01); *G10L 19/20* (2013.01); *G10L 19/0204* (2013.01)

(58) Field of Classification Search
CPC ..... G10L 19/008
See application file for complete search history.

(56) References Cited

U.S. PATENT DOCUMENTS 8,504,184 B2 * 8/2013 Ishikawa ..... H04M 3/56 700/94
8,654,994 B2 * 2/2014 Oh ..... G10L 19/008 381/119

(Continued)

OTHER PUBLICATIONS

Pulkki, Ville. "Applications of directional audio coding in audio." Proceedings of the 19th International Congress of Acoustics. 2007.*

(Continued)

*Primary Examiner* — Brian Albertalli

(57) ABSTRACT

An encoder (1201) for encoding a plurality of audio signals comprises a selector (1303) which selects a subset of time-frequency tiles to be downmixed and a subset of tiles to be non-downmix. A downmix indication is generated which indicates whether tiles are encoded as downmixed encoded tiles or as non-downmix tiles. An encoded signal comprising the encoded tiles and the downmix indication is fed to a decoder (1203) which includes a receiver (1401) for receiving the signal. A generator (1403) generates output signals from the encoded time-frequency tiles where the generation of the output signals includes an upmixing for tiles that are indicated by the downmix indication to be encoded downmixed tiles. The invention may provide more flexible and/or improved encoding/decoding and may specifically provide improved scalability, especially at higher data rates.

16 Claims, 17 Drawing Sheets

(51) Int. Cl.

| | |
|---|---|
| ***G10L 19/008*** | (2013.01) |
| ***G10L 19/18*** | (2013.01) |
| *G10L 19/02* | (2013.01) |

(56) References Cited

U.S. PATENT DOCUMENTS

| | | | | |
|---|---|---|---|---|
| 2005/0058304 | A1 | 3/2005 | Baumgarte et al. | |
| 2007/0174062 | A1 | 7/2007 | Mehrotra et al. | |
| 2007/0194952 | A1* | 8/2007 | Breebaart | G10L 19/008 341/50 |
| 2008/0205676 | A1* | 8/2008 | Merimaa | G10L 19/008 381/310 |
| 2008/0232617 | A1* | 9/2008 | Goodwin | G10L 19/008 381/307 |
| 2008/0249769 | A1* | 10/2008 | Baumgarte | G10L 25/69 704/227 |
| 2009/0125314 | A1* | 5/2009 | Hellmuth | G10L 19/008 704/501 |
| 2009/0210239 | A1* | 8/2009 | Yoon | G10L 19/20 704/500 |
| 2011/0022402 | A1* | 1/2011 | Engdegard | H04S 7/30 704/501 |
| 2011/0038423 | A1 | 2/2011 | Lee et al. | |
| 2011/0064249 | A1* | 3/2011 | Jang | G11B 27/034 381/119 |
| 2012/0020482 | A1* | 1/2012 | Kim | G10L 19/008 381/23 |
| 2012/0078642 | A1* | 3/2012 | Seo | G10L 19/008 704/500 |
| 2012/0177204 | A1* | 7/2012 | Hellmuth | G10L 19/008 381/22 |
| 2014/0350944 | A1* | 11/2014 | Jot | G10L 19/008 704/500 |
| 2014/0372130 | A1* | 12/2014 | Yoo | G10L 19/008 704/500 |
| 2015/0356976 | A1* | 12/2015 | Herre | G10L 19/008 704/500 |

OTHER PUBLICATIONS

Herre, Jürgen, and Leon Terentiv. "Parametric coding of audio objects: Technology, performance, and opportunities." Audio Engineering Society Conference: 42nd International Conference: Semantic Audio. Audio Engineering Society, 2011.*

Herre, Jürgen, et al. "MPEG Spatial Audio Object Coding—the ISO/MPEG standard for efficient coding of interactive audio scenes." Journal of the Audio Engineering Society 60.9 (2012): 655-673.*

Terentiev, Leonid, et al. "SAOC for Gaming—The Upcoming MPEG Standard on Parametric Object Based Audio Coding." Audio Engineering Society Conference: 35th International Conference: Audio for Games. Audio Engineering Society, 2009.*

Kurniawati, Evelyn, Samsudin Ng, and Sapna George. "A Study of MPEG Surround Configurations and Its Performance Evaluation." Audio Engineering Society Convention 126. Audio Engineering Society, 2009.*

Breebaart, Jeroen, et al. "Spatial audio object coding (SAOC)—The upcoming MPEG standard on parametric object based audio coding." Audio Engineering Society Convention 124. Audio Engineering Society, 2008.*

Faller, Christof. "Parametric joint-coding of audio sources." Audio Engineering Society Convention 120. Audio Engineering Society, 2006.*

Bosi et al: "ISO/IEC MPEG-2 Advanced Audio Coding"; Journal of the Audio Engineering Society, vol. 45, No. 10, Oct. 1997, pp. 789-812.

Kelly et al: "The Continuity Illusion Revisited:Coding of Multiple Concurrent Sound Sources"; Proc. 1st IEEE Benelux Workshop on Model Based Processing and Coding of Audio (MPCA-2002), Leuven, Belgium, Nov. 2002, pp. 9-12.

Jot et al: Beyond Surround Sound-Creation, Coding and Reproduction of 3-D Audio Soundtracks; AES Convention 131, Oct. 2011, Paper 8463, pp. 1-11.

* cited by examiner

ENCODING AND DECODING OF AUDIO SIGNALS

CROSS-REFERENCE TO PRIOR APPLICATIONS

This application is the U.S. National Phase application under 35 U.S.C. §371 of International Application No. PCT/IB2013/055628, filed on Jul. 9, 2013, which claims the benefit of U.S. Provisional Patent Application No. 61/669,197, filed on Jul. 9, 2012. These applications are hereby incorporated by reference herein.

FIELD OF THE INVENTION

The invention relates to encoding and/or decoding of a plurality of audio signals and in particular, but not exclusively, to encoding and decoding of a plurality of audio objects.

BACKGROUND OF THE INVENTION

Digital encoding of various source signals has become increasingly important over the last decades as digital signal representation and communication increasingly has replaced analogue representation and communication. For example, audio content, such as speech and music, is increasingly based on digital content encoding.

Audio encoding formats have been developed to provide increasingly capable, varied and flexible audio services and in particular audio encoding formats supporting spatial audio services have been developed.

Well known spatial audio coding technologies like DTS and Dolby Digital produce a coded multi-channel audio signal that represents the spatial image as a number of channels that are placed around the listener at fixed positions. For a speaker setup which is different from the setup that corresponds to the multi-channel signal, the spatial image will be suboptimal. Also, these channel based audio coding systems are typically not able to cope with a different number of speakers.

The approach of such conventional approaches is illustrated in FIG. 1 (where the letter c refers to audio channel). The input channels (e.g. 5.1 channels) are provided to an encoder that performs matrixing to exploit inter-channel relations, following by coding of the matrixed signal into a bit-stream. In addition the matrixing information may also be conveyed to the decoder as part of the bitstream. At the decoder side this process is reversed.

MPEG Surround provides a multi-channel audio coding tool that allows existing mono- or stereo-based coders to be extended to multi-channel audio applications. FIG. 2 illustrates an example of elements of an MPEG Surround system. Using spatial parameters obtained by analysis of the original multichannel input, an MPEG Surround decoder can recreate the spatial image by a controlled upmix of the mono- or stereo signal to obtain a multichannel output signal.

Since the spatial image of the multi-channel input signal is parameterized, MPEG Surround allows for decoding of the same multi-channel bit-stream by rendering devices that do not use a multichannel speaker setup. An example is virtual surround reproduction on headphones, which is referred to as the MPEG Surround binaural decoding process. In this mode a realistic surround experience can be provided while using regular headphones. Another example is the transformation of higher order multichannel outputs, e.g. 7.1 channels, to lower order setups, e.g. 5.1 channels.

The approach of MPEG Surround (and similar parametric multi-channel coding approaches such as Binaural Cue Coding or Parametric Stereo) is illustrated in FIG. 3. In contrast to the discrete or waveform coding approach, the input channels are downmixed (e.g. to a stereo mix). This downmix is subsequently coded using traditional coding techniques such as the AAC family of codecs. In addition to the coded downmix, a representation of the spatial image is also transmitted in the bit-stream. The decoder reverses the process.

In order to provide for a more flexible representation of audio, MPEG standardized a format known as 'Spatial Audio Object Coding' (MPEG-D SAOC). In contrast to multichannel audio coding systems such as DTS, Dolby Digital and MPEG Surround, SAOC provides efficient coding of individual audio objects rather than audio channels. Whereas in MPEG Surround, each speaker channel can be considered to originate from a different mix of sound objects, SAOC makes individual sound objects available at the decoder side for interactive manipulation as illustrated in FIG. 4. In SAOC, multiple sound objects are coded into a mono or stereo downmix together with parametric data allowing the sound objects to be extracted at the rendering side thereby allowing the individual audio objects to be available for manipulation e.g. by the end-user.

Indeed, similarly to MPEG Surround, SAOC also creates a mono or stereo downmix. In addition object parameters are calculated and included. At the decoder side, the user may manipulate these parameters to control various features of the individual objects, such as position, level, equalization, or even to apply effects such as reverb. FIG. 5 illustrates an interactive interface that enables the user to control the individual objects contained in an SAOC bitstream. By means of a rendering matrix individual sound objects are mapped onto speaker channels.

FIG. 6 provides a high level block diagram of a parametric approach of SAOC (or similar object coding systems). The object signals (o) are downmixed and the resulting downmix is coded. In addition parametric object data is transmitted in the bit-stream relating the individual objects to the downmix. At the decoder side, the objects are decoded and rendered to channels according to the speaker configuration. Typically, in such an approach it is more efficient to combine the decoding of the objects and the speaker rendering.

The variation and flexibility in the rendering configurations used for rendering spatial sound has increased significantly in recent years with more and more reproduction formats becoming available to the mainstream consumer. This requires flexible representation of audio. Important steps have been taken with the introduction of the MPEG Surround codec. Nevertheless, audio is still produced and transmitted for a specific loudspeaker setup. Reproduction over different setups and over non-standard (i.e. flexible or user-defined) speaker setups is not specified.

This problem can be partly solved by SAOC, which transmits audio objects instead of reproduction channels. This allows the decoder-side to place the audio objects at arbitrary positions in space, provided that the space is adequately covered by speakers. This way there is no relation between the transmitted audio and the reproduction setup, hence arbitrary speaker setups can be used. This is advantageous for e.g. home cinema setups in a typical living room, where the speakers are almost never at the intended positions because of the layout of living room. In SAOC, it is decided at the decoder side where the objects are placed in the sound scene. This is often not desired from an artistic point-of-view, and therefore the SAOC standard does provide ways to transmit a default rendering matrix in the bitstream, eliminating the decoder responsibility. These rendering matrices are again tied to specific speaker configurations.

In SAOC, as a result of the downmixing, the object extraction only works within certain boundaries. It is typically not possible to extract a single object with high enough separation from the other objects for reproduction without the other objects, e.g. in a Karaoke use case. Furthermore, because of the parameterization, the SAOC technology does not scale well with bitrate. In particular, the approach of downmixing and extracting (upmixing) audio objects results in some inherent information loss that is not fully compensated even at very high bitrates. Thus, even if the bitrate is increased, the resulting audio quality is typically degraded and prevents the encoding/decoding operations from being fully transparent.

In order to address this, SAOC supports so called residual coding which can be applied for a limited set of objects (up to and including 4, which has been a design choice). The residual coding basically transmits additional bitstream components that code the error signals (including the cross-talk from the other objects in that object) such that a limited number of objects can be extracted with a high degree of object separation. Residual waveform components may be supplied up to a specific frequency such that the quality can be gradually increased. The resulting object is thus a combination of a parametric component and a waveform component.

Another specification for an audio format for 3D audio is being developed by the 3D Audio Alliance (3DAA) which is an industry alliance initiated by SRS (Sound Retrieval System) Labs. 3DAA is dedicated to develop standards for the transmission of 3D audio, that "will facilitate the transition from the current speaker feed paradigm to a flexible object-based approach". In 3DAA, a bitstream format is to be defined that allows the transmission of a legacy multichannel downmix along with individual sound objects. In addition, object positioning data is included. The principle of generating a 3DAA audio stream is illustrated in FIG. 7.

In the 3DAA approach, the sound objects are received separately in the extension stream and these may be extracted from the multi-channel downmix. The resulting multi-channel downmix is rendered together with the individually available objects.

In 3DAA, a multichannel reference mix can be transmitted with a selection of audio objects. 3DAA transmits the 3D positional data for each object. The objects can then be extracted using the 3D positional data. Alternatively, the inverse mix-matrix may be transmitted, describing the relation between the objects and the reference mix. The illustration of FIG. 6 may be considered to also correspond to the approach of 3DAA.

Both the SAOC and 3DAA approaches incorporate the transmission of individual audio objects that can be individually manipulated at the decoder side. A difference between the two approaches is that SAOC provides information on the audio objects by providing parameters characterizing the objects relative to the downmix (i.e. such that the audio objects are generated from the downmix at the decoder side) whereas 3DAA provides audio objects as full and separate audio objects (i.e. that can be generated independently from the downmix at the decoder side).

In MPEG a new work item on 3D Audio is under construction. This is referred to as MPEG-3D Audio and is intended to become part of the MPEG-H suite along with HEVC video coding and DASH systems. FIG. 8 illustrates the current high level block diagram of the intended MPEG 3D Audio system.

In addition to the traditional channel based format, the approach is intended to also support object based and scene based formats. An important aspect of the system is that its quality should scale to transparency for increasing bitrate, i.e. that as the data rate increases the degradation caused by the encoding and decoding should continue to reduce until it is insignificant. However, such a requirement tends to be problematic for parametric coding techniques that have been used quite heavily in the past (viz. HE-AAC v2, MPEG Surround, SAOC, USAC). In particular, the compensation of information loss for the individual signals tends to not be fully compensated by the parametric data even at very high bit rates. Indeed, the quality will be limited by the intrinsic quality of the parametric model.

MPEG-3D Audio furthermore seeks to provide a resulting bitstream which is independent of the reproduction setup. Envisioned reproduction possibilities include flexible loudspeaker setups up to 22.2 channels, as well as virtual surround over headphones and closely spaced speakers.

Another approach is known as DirAC—Directional Audio Coding (DirAC) which is similar to MPEG Surround and SAOC in the sense that a downmix is transmitted along with parameters that enable a reproduction of a spatial image at the synthesis side. In DirAC these parameters represent results from direction and diffuseness analysis (azimuth, elevation and diffuseness $\Psi(t/f)$). During synthesis the downmix is divided dynamically into two streams, one that corresponds to non-diffuse sound (weight $\sqrt{1-\Psi}$), and another that corresponds to the diffuse sound (weight $\sqrt{\Psi}$). The non-diffuse sound stream is reproduced with a technique aiming at point-like sound sources, and the diffuse sound stream with a technique aiming at the perception of sound lacking prominent direction. The approach of DirAC is illustrated in FIG. 9.

DirAC can be considered a recording based encoding/decoding system in accordance with the approach of FIG. 10. In the system, the microphone signals (m) are coded. This can e.g. be performed similarly to the parametric approach using downmixing and coding of spatial information. At the decoder, the microphone signals can be reconstructed, and based on a provided speaker configuration, the microphone signals can be rendered to channels. It is noted that for efficiency reasons, the decoding and rendering process can be integrated into a single step.

In "The continuity illusion revisited: coding of multiple concurrent sound sources", M. Kelly et. al. Proc. MPCA-2002, Louvain, Belgium, Nov. 15, 2002 it is suggested to not use parametric encoding and downmixing but instead to encode the individual audio objects individually using discrete/waveform encoding. The approach is illustrated in FIG. 11. As illustrated, all objects are coded simultaneously and transmitted to the decoder. At the decoder side, the objects are decoded and rendered according to a speaker configuration to channels. The approach may provide improved audio quality, and in particular has the potential of scaling to transparency. However, the system does not provide significant coding efficiency and requires relative high data rates even for lower audio quality.

Thus, there are a number of different approaches seeking to provide efficient audio encoding.

Audio content is nowadays shared between an increasing number of different reproduction devices. For example, the audio may be experienced over headphones, small speakers, via a docking station, and/or using various multichannel setups. For multichannel setups, the ITU recommended 5.1 speaker setup, which conventionally has been assumed as the nominal speaker setup, is often not even approximately applied when rendering the audio content. For example, an accurate positioning of five spatial speakers in accordance with the setup is rarely found in typical living rooms. Speakers are placed at convenient locations instead of at the recommended angles and distances. Furthermore, alternative setups like 4.1, 6.1, 7.1 or even 22.2 configurations may be used. In order to provide the best experience in all of these reproduction schemes, a trend towards object coding or scene coding can be observed. Such approaches are increasingly introduced (currently mainly for cinema applications but domestic use is expected to become more common) to replace the conventional audio channel approach where each audio channel is associated with a nominal position.

When the number of reproduction channels (i.e. speakers) and their locations are unknown, an audio scene can best be represented by the individual audio objects in the scene. At the decoder side the objects can then each be rendered separately on the reproduction channels such that the spatial perception is closest to the intended perception.

Coding the objects as separate audio signals/streams requires a relatively high bitrate. The available solutions (viz. SAOC, DirAC, 3DAA, etc) transmit downmixed object signals and means to reconstruct the object signals from this downmix. This results in a significant bitrate reduction.

SAOC provides speaker independent audio by efficient object coding in a downmix with object extraction parameters, 3DAA defines a format where the scene is described in terms of object positions. DirAC attempts an efficient coding of audio objects by using a B-format downmix.

Thus, these systems are suitable for efficient and flexible coding and rendering of audio content. Significant data rate reductions can be achieved and accordingly relatively low data rate implementations can still provide reasonable or good audio quality. However, an issue with such systems is that the audio quality is inherently limited by the parametric encoding and downmixing. Even as the available data rate is increased, it is not possible to achieve full transparency where the impact of the encoding/decoding operations cannot be detected. In particular, objects cannot be reconstructed without cross-talk from other objects even at high data rates. This results in a reduction of audio quality and spatial perception when objects are separated in spatial reproduction (i.e. rendered at different positions). A further drawback is that inter-object coherence is mostly not reconstructed properly, which is an important characteristic for creating spatial perception. Attempts to reconstruct the coherence are based on use of decorrelators and tend to result in suboptimal audio quality.

An alternative approach of individually waveform encoding the audio objects may allow high quality at high data rates, and may in particular provide full scalability including a full transparent encoding/decoding. However, such approaches are unsuitable for low data rates where they do not provide an efficient encoding.

Thus, parametric downmix based encodings are suitable for low data rates and scalability towards lower data rates whereas waveform object encodings are suitable for high data rates and scalability towards high data rates.

Scalability is a very important criterion for future audio systems, and therefore it is highly desirable to have efficient scalability that extends to both very low data rates and to very high data rates, and in particular to full transparency. Furthermore, it is desirable that such scalability has a low granularity of the scalability.

Hence, an improved audio coding/decoding approach would be advantageous and in particular a system allowing increased flexibility, reduced complexity, improved scalability and/or improved performance would be advantageous.

SUMMARY OF THE INVENTION

Accordingly, the Invention seeks to preferably mitigate, alleviate or eliminate one or more of the above mentioned disadvantages singly or in any combination.

According to an aspect of the invention there is provided a decoder comprising: a receiver (1401) for receiving an encoded data signal representing a plurality of audio signals, the encoded data signal comprising encoded time-frequency tiles for the plurality of audio signals, the encoded time-frequency tiles comprising non-downmix time-frequency tiles and downmix time-frequency tiles, each downmix time-frequency tile being a downmix of at least two time-frequency tiles of the plurality of audio signals and each non-downmix time-frequency tile representing only one time-frequency tile of the plurality of audio signals, the encoded data signal further comprising a downmix indication for time-frequency tiles of the plurality of audio signals, the downmix indication indicating whether time-frequency tiles of the plurality of audio signals are encoded as downmix time-frequency tiles or non-downmix time-frequency tiles; a generator (1403) for generating a set of output signals from the encoded time-frequency tiles, the generation of the output signals comprising an upmixing for encoded time-frequency tiles that are indicated by the downmix indication to be downmix time-frequency tiles.

The invention may allow improved audio decoding, and in particular may in many embodiments allow an improved scalability. In particular, the invention may in many embodiments allow data rate scalability to transparency. In particular, encoding artifacts known for parametric encoding at higher data rates may be avoided or mitigated in many scenarios.

The approach may further provide efficient encoding, and in particular may provide efficient encoding at lower data rates. A high degree of scalability can be achieved, and in particular scalability to efficient encoding at lower data rates and very high quality (and specifically transparency) at high data rates can be achieved.

The invention may provide a very flexible system with a high degree of adaptation and optimization being possible. The encoding and decoding operation may be adapted not only to the overall characteristics of the audio signals but also to characteristics of individual time-frequency tiles. Accordingly a highly efficient coding can be achieved.

The upmixing of a downmix time-frequency tile may be a separate operation or may be integrated with other operations. For example, the upmixing may be part of a matrix (vector) operation that multiplies signal values for the time-frequency tile with matrix (vector) coefficients where the matrix (vector) coefficients reflect an upmix operation but may further reflect other operations, such as a mapping to output rendering channels. The upmixing need not be an upmixing of all components of a downmix. For example, the upmix may be a partial upmix to generate only one of the time-frequency tiles comprised in the downmix.

A time-frequency tile is a time-frequency interval. A time-frequency tile of the output signals may be generated from encoded time-frequency tiles covering the same time interval and frequency interval. Similarly, each downmix time-frequency tile may be a downmix of time-frequency tiles of the audio signals covering the same time interval and frequency interval. The time-frequency intervals may be on a uniform grid or may e.g. be on a non-uniform grid, in particular for the frequency dimension. Such a uniform grid may for example be used to exploit and reflect the logarithmic sensitivity of the human hearing.

For encoded time-frequency tiles that are not indicated to be downmix time-frequency tiles, the generation of the output signals need (do) not include upmixing.

Some time-frequency tiles of the plurality of audio signals may not be represented in the encoded time-frequency tiles. Time-frequency tiles of the plurality of audio signals may not be represented in either an encoded downmix time-frequency tile or a non-downmix time-frequency tile.

In some embodiments, the indicating of whether time-frequency tiles of the plurality of audio signals are encoded as downmix time-frequency tiles or non-downmix time-frequency tiles may be provided with reference to the encoded time-frequency tiles. In some embodiments, a downmix indication value may be provided individually for time-frequency tiles of the plurality of audio signals. Equivalently, in some embodiments a downmix indication value may be provided for a group of time-frequency tiles of the plurality of audio signals.

A non-downmix time-frequency tile represents data for only one time-frequency tile of the audio signals whereas a downmix time-frequency tile represents two or more time-frequency tiles of the audio signals. The downmix time-frequency tiles and non-downmix time-frequency tiles may in different embodiments be encoded in different ways in the encoded data signal, including for example each tile being separately encoded, some or all being jointly encoded etc.

In accordance with an optional feature of the invention, the encoded data signal furthermore comprises parametric upmix data, and wherein the generator (1403) is arranged to adapt the upmixing operation in response to the parametric data.

This may provide improved performance, and in particular may provide improved audio quality at lower data rates. The invention may allow a flexible adaptation and interworking of e.g. waveform and parametric encoding to provide a very scalable system, and in particular a system capable of providing very high audio quality for high data rates while providing efficient encoding at lower data rates.

The generator may specifically generate the output signals in response to the parametric upmix data for encoded time-frequency tiles that are indicated by the downmix indication to be downmix time-frequency tiles (and not for encoded time-frequency tiles that are indicated by the downmix indication to not be encoded downmix time-frequency tiles).

In accordance with an optional feature of the invention, the generator (1403) comprises a rendering unit arranged to map time-frequency tiles for the plurality of audio signals to output signals corresponding to a spatial sound source configuration.

This may provide efficient generation of audio signals suitable for rendering by a given spatial sound source (typically speaker) configuration. The upmixing and render mapping may in some embodiments be performed as a single integrated operation, e.g. as a single matrix multiplication.

In some embodiments, the generator is arranged to generate the decoded audio signals from the encoded time-frequency tiles, and to generate the audio signals by spatially mapping the decoded audio signals to the set of output signals, the set of output signals corresponding to a spatial sound source setup.

In accordance with an optional feature of the invention, the generator (1403) is arranged to generate time-frequency tiles for the set of output signals by applying matrix operations to the encoded time-frequency tiles, coefficients of matrix operations including upmix components for encoded time-frequency tiles for which the downmix indication indicates that the encoded time-frequency tile is a downmix time-frequency tile and not for encoded time-frequency tiles for which the downmix indication indicates that the encoded time-frequency tile is a non-downmix time-frequency tile.

This may provide a particularly efficient operation. The matrix operations may be applied to the signal samples of the encoded time-frequency tiles. The signal samples may be generated by a decoding operation.

In accordance with an optional feature of the invention, at least one audio signal is represented in the decoded signal by at least one non-downmix time-frequency tile and at least one downmix time-frequency tile.

The individual audio signals may be represented by both downmix time-frequency tiles and non-downmix time-frequency tiles. Each time-frequency tile of the audio signal may be represented by a downmix time-frequency tile or a non-downmix time-frequency tile without requiring that all time-frequency tiles are represented in the same way. The approach may allow for a high degree of flexibility and optimization, and may specifically result in improved audio quality, coding efficiency and/or scalability.

In accordance with an optional feature of the invention, the downmix indication for at least one downmix time-frequency tile comprises a link between an encoded downmix time-frequency tile and a time-frequency tile of the plurality of audio signals.

This may in many embodiments allow encoding to be flexibly optimized on a time-frequency tile basis. The approach may allow a high degree of flexibility and optimization, and may specifically result in improved audio quality, coding efficiency and/or scalability.

In accordance with an optional feature of the invention, at least one audio signal of the plurality of audio signals is represented by two downmix time-frequency tiles being downmixes of different set of audio signals of the plurality of audio signals.

This may in many embodiments allow encoding to be flexibly optimized on a time-frequency tile basis. The approach may allow a high degree of flexibility and optimization, and may specifically result in improved audio quality, coding efficiency and/or scalability.

In accordance with an optional feature of the invention, at least one audio signal of the plurality of audio signals is represented by encoded time-frequency tiles that include at least one encoded time-frequency tile not being an non-downmix time-frequency tile or a downmix time-frequency tile.

This may allow improved encoding efficiency in some embodiments. The encoded time-frequency tiles not being non-downmix time-frequency tiles or a downmix time-frequency tiles may for example be encoded as null-time-frequency tiles (encoded as an empty time-frequency tile with no signal data), or may e.g. be encoded using other techniques such as mid/side encoding.

In accordance with an optional feature of the invention, at least one downmix time-frequency tile is a downmix of an audio object not being associated with a nominal sound source position of a sound source rendering configuration and an audio channel being associated with a nominal sound source position of a sound source rendering configuration.

This may provide improved flexibility and/or a more efficient encoding. Specifically, the downmix time-frequency tiles may include downmixes of time-frequency tiles of audio objects and audio channels.

In accordance with an optional feature of the invention, at least some of the non-downmix time-frequency tiles are waveform encoded.

This may allow efficient and potentially high quality encoding/decoding. In many scenarios it may allow improved scalability, and in particular scalability to transparency.

In accordance with an optional feature of the invention, at least some of the downmix time-frequency tiles are waveform encoded.

This may allow efficient and potentially high quality encoding/decoding.

In accordance with an optional feature of the invention, the generator (1403) is arranged to upmix the downmix frequency tiles to generate upmixed time-frequency tiles for at least one of the plurality of audio signals of a downmix time-frequency tile; and the generator is arranged to generate time-frequency tiles for the set of output signals using the upmixed time-frequency tiles for tiles for which the downmix indication indicates that the encoded time-frequency tile is a downmix time-frequency tile.

This may facilitate implementation and/or provide high performance.

In accordance with another aspect of the invention, method of decoding comprising: receiving an encoded data signal representing a plurality of audio signals, the encoded data signal comprising encoded time-frequency tiles for the plurality of audio signals, the encoded time-frequency tiles comprising non-downmix time-frequency tiles and downmix time-frequency tiles, each downmix time-frequency tile being a downmix of at least two time-frequency tiles of the plurality of audio signals and each non-downmix time-frequency tile representing only one time-frequency tile of the plurality of audio signals, the encoded data signal further comprising a downmix indication for time-frequency tiles of the plurality of audio signals, the downmix indication indicating whether time-frequency tiles of the plurality of audio signals are encoded as downmix time-frequency tiles or non-downmix time-frequency tiles; and generating a set of output signals from the encoded time-frequency tiles, the generation of the output signals comprising an upmixing for encoded time-frequency tiles that are indicated by the downmix indication to be downmix time-frequency tiles.

In accordance with another aspect of the invention, encoder comprising: a receiver (1301) for receiving a plurality of audio signals, each audio signal comprising a plurality of time-frequency tiles; a selector (1303) for selecting a first subset of the plurality of time-frequency tiles to be downmixed; a downmixer (1305) for downmixing time-frequency tiles of the first subset to generate downmixed time-frequency tiles; a first encoder (1307) for generating downmix encoded time-frequency tiles by encoding the downmix time-frequency tiles; a second encoder (1309) for generating non-downmix time-frequency tiles by encoding a second subset of the time-frequency tiles of the audio signals without downmixing of time-frequency tiles of the second subset; a unit (1311) for generating a downmix indication indicating whether time-frequency tiles of the first subset and the second subset are encoded as downmix encoded time-frequency tiles or as non-downmix time-frequency tiles; an output (1313) for generating an encoded audio signal representing the plurality of audio signals, the encoded audio signal comprising the non-downmix time-frequency tiles, the downmix encoded time-frequency tiles, and the downmix indication.

The invention may allow improved audio encoding, and in particular may in many embodiments allow an improved scalability. In particular, the invention may in many embodiments allow data rate scalability to transparency. In particular, encoding artifacts known for parametric encoding at higher data rates may be avoided or mitigated in many scenarios.

The approach may further provide efficient encoding, and in particular may provide efficient encoding at lower data rates. A high degree of scalability can be achieved, and in particular scalability to efficient encoding at lower data rates and very high quality (and specifically transparency) at high data rates can be achieved.

The invention may provide a very flexible system with a high degree of adaptation and optimization being possible. The encoding and decoding operation may be adapted not only to the overall characteristics of the audio signals but also to characteristics of individual time-frequency tiles. Accordingly a highly efficient coding can be achieved.

The downmixer may further be arranged to generate parametric data for restoring time-frequency tiles being downmixed from the downmixed time-frequency tiles; and the output may be arranged to include the parametric data in the encoded audio signal.

The first and second encoders may be implemented as a single encoder, e.g. encoding the downmixes sequentially and possibly using the same encoding algorithm.

The encoding process may take a set of downmix time-frequency tiles and individual time-frequency tiles into account to improve efficiency and quality.

According to an optional feature of the invention the selector (1303) is arranged to select time-frequency tiles for the first subset in response to a target data rate for the encoded audio signal.

This may provide improved performance, and may in particular allow an efficient scaling of the encoded audio signal.

According to an optional feature of the invention, the selector (1303) is arranged to select time-frequency tiles for the first subset in response to at least one of: an energy of the time-frequency tiles; a spatial characteristic of the time-frequency tiles; and a coherence characteristic between pairs of the time-frequency tiles.

This may provide improved performance in many embodiments and for many signals.

In accordance with another aspect of the invention, method of encoding comprising: receiving a plurality of audio signals, each audio signal comprising a plurality of time-frequency tiles; selecting a first subset of the plurality of time-frequency tiles to be downmixed; downmixing time-frequency tiles of the first subset to generate downmixed time-frequency tiles; generating downmix encoded time-frequency tiles by encoding the downmixed time-frequency tiles; generating non-downmix time-frequency tiles by encoding a second subset of the time-frequency tiles of the audio signals without downmixing of time-frequency tiles of the second subset; generating a downmix indication indicating whether time-frequency tiles of the first subset and the second subset are encoded as downmixed encoded time-frequency tiles or as non-downmix time-frequency tiles; and generating an encoded audio signal representing the plurality of audio signals, the encoded audio signal comprising the non-downmix time-frequency tiles, the downmix encoded time-frequency tiles, and the downmix indication.

In accordance with another aspect of the invention, encoding and decoding system comprising the encoder and the decoder described above.

These and other aspects, features and advantages of the invention will be apparent from and elucidated with reference to the embodiment(s) described hereinafter.

BRIEF DESCRIPTION OF THE DRAWINGS

Embodiments of the invention will be described, by way of example only, with reference to the drawings, in which.

DETAILED DESCRIPTION OF SOME EMBODIMENTS OF THE INVENTION

Figure 1:
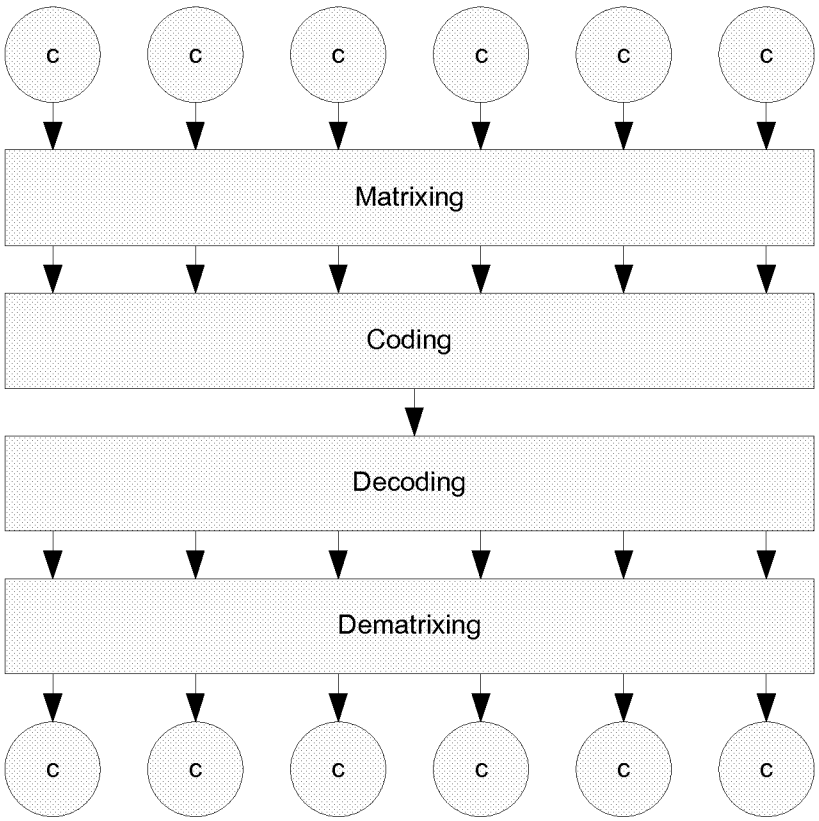
Prior Art FIG. 1
FIG. 1 illustrates an example of the principle of audio encoding of a multi-channel signal in accordance with prior art.
Figure 2:
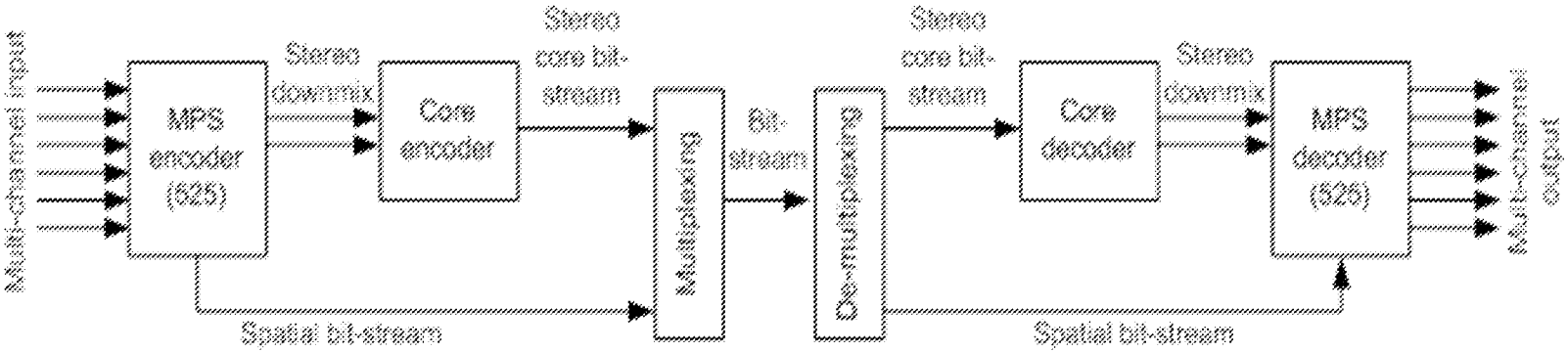
Prior Art FIG. 2
FIG. 2 illustrates an example of elements of an MPEG Surround system in accordance with prior art.
Figure 3:
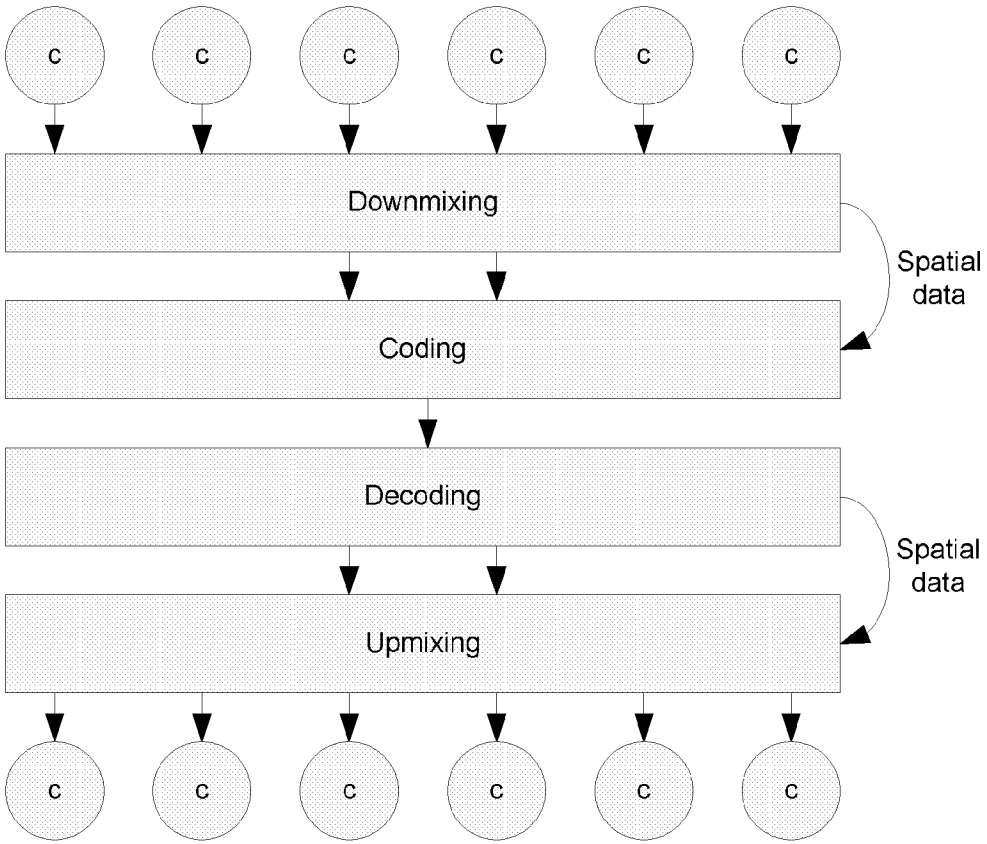
Prior Art FIG. 3
FIG. 3 illustrates an example of elements of an MPEG Surround system in accordance with prior art.
Figure 4:
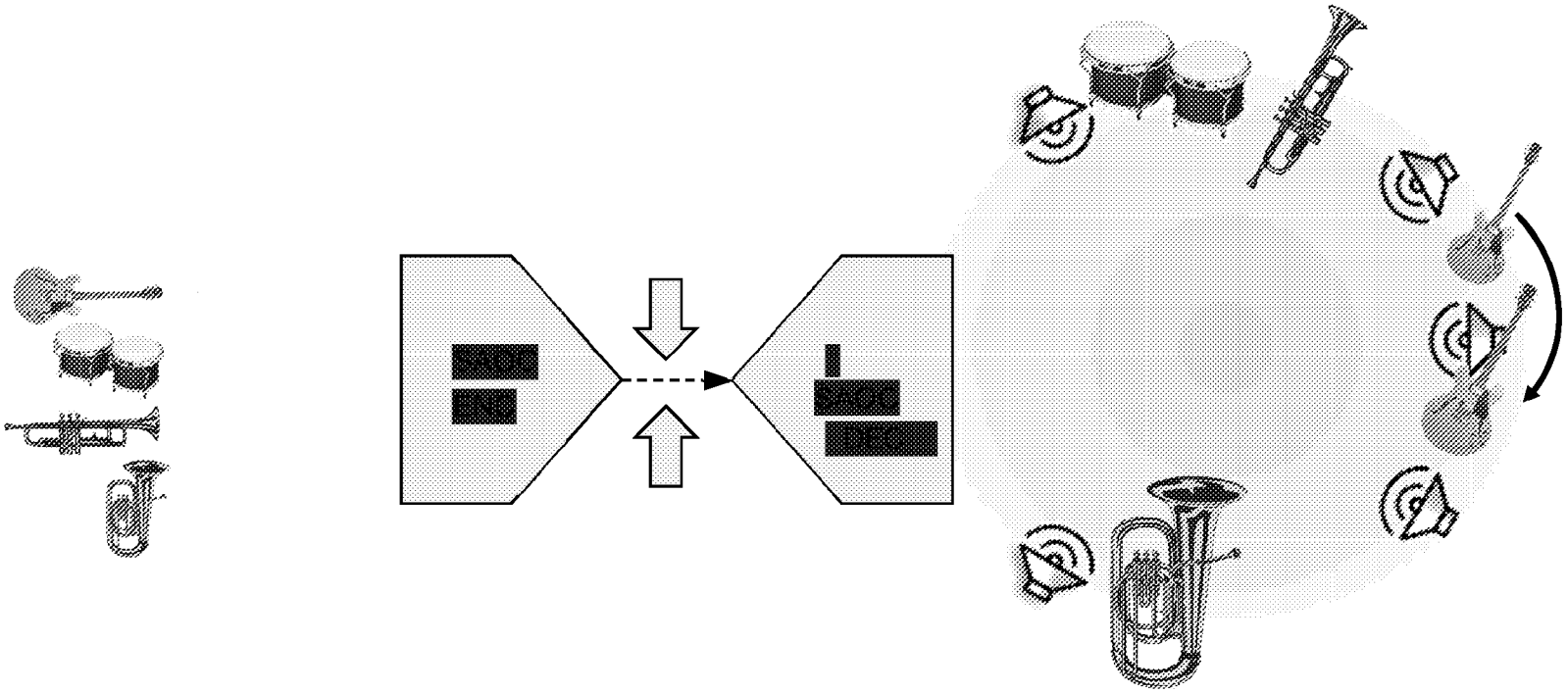
Prior Art FIG. 4
FIG. 4 illustrates an example of elements of an SAOC system in accordance with prior art.
Figure 5:
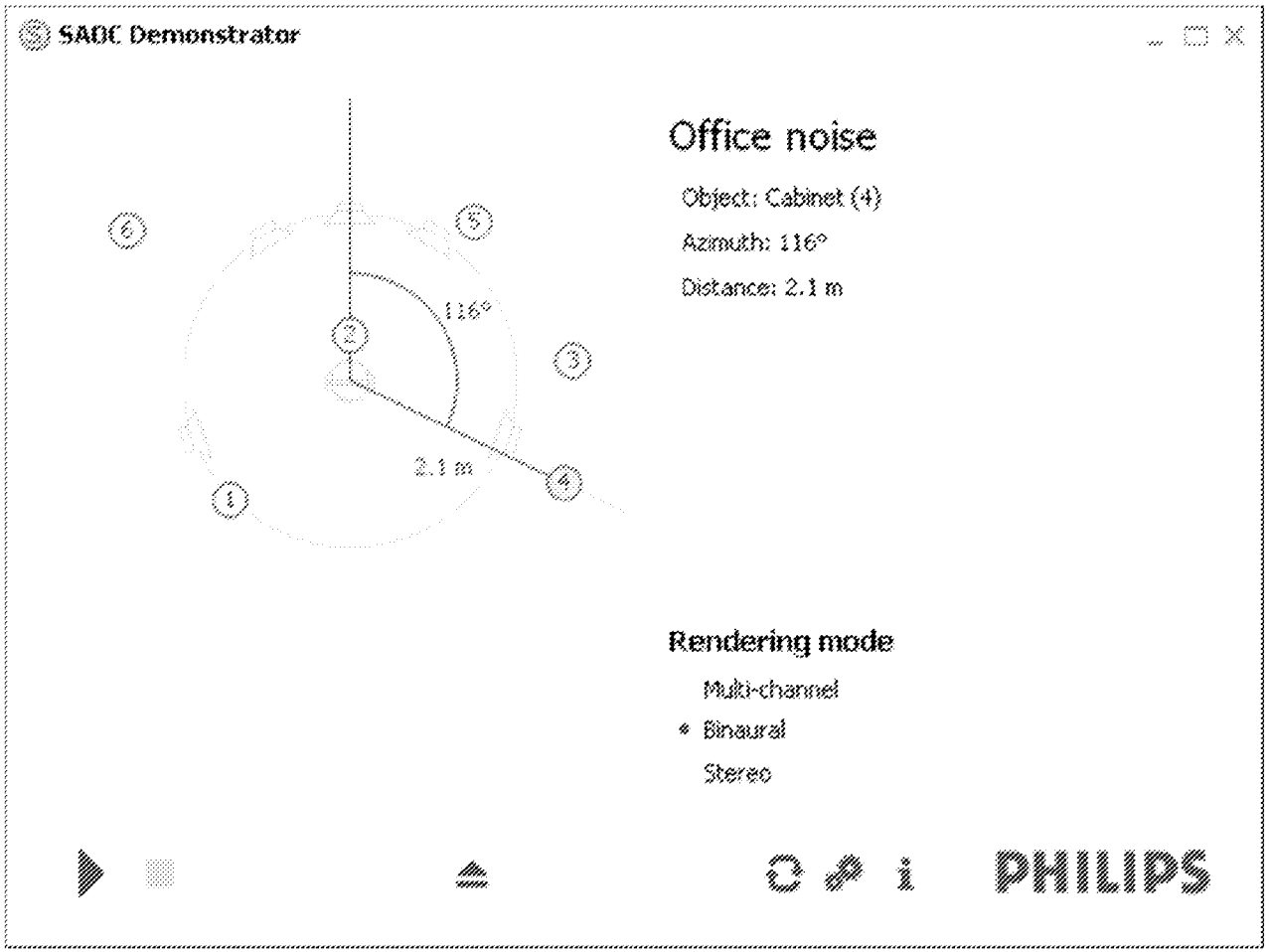
FIG. 5 Prior Art
FIG. 5 illustrates an interactive interface that enables the user to control the individual objects contained in a SAOC bitstream.
Figure 6:
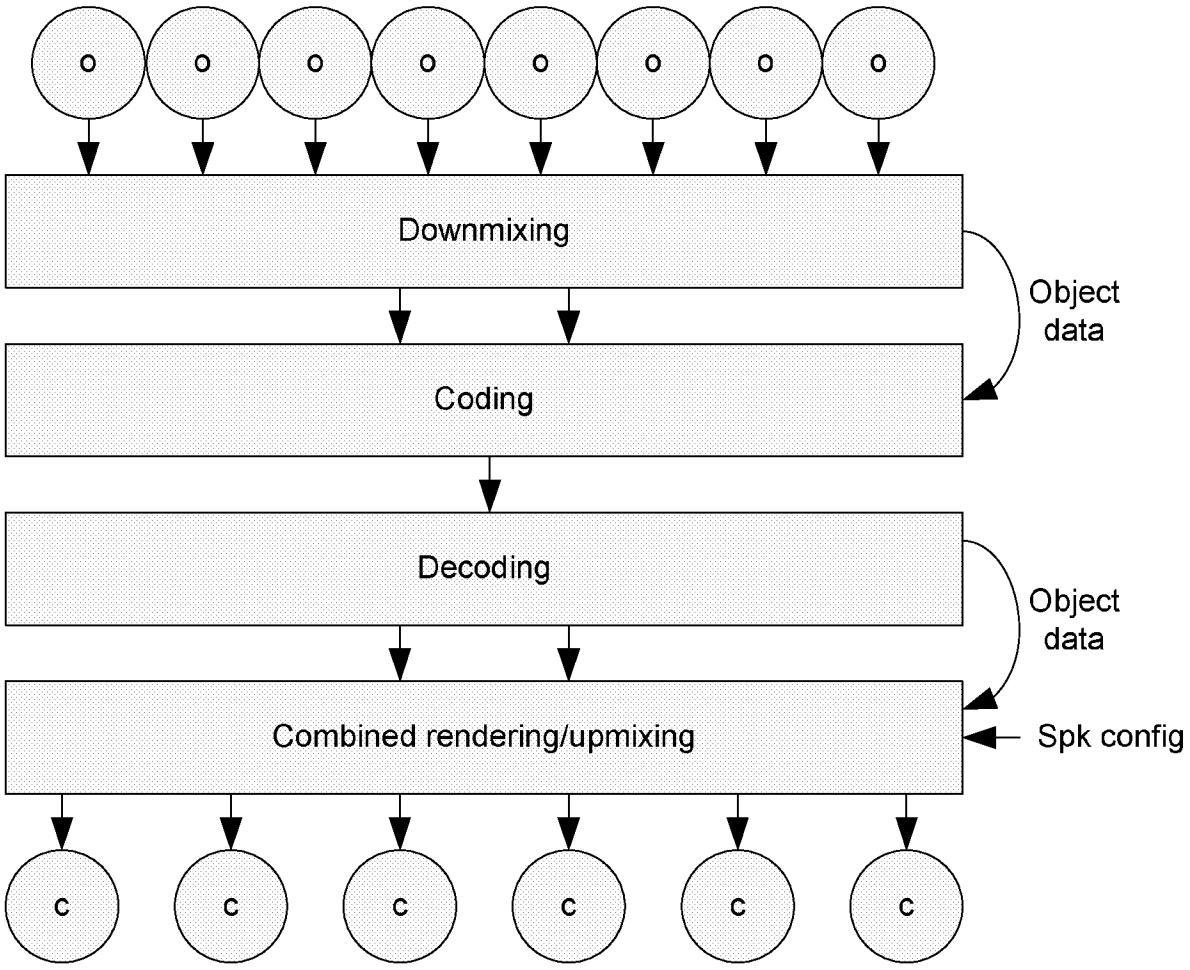
Prior Art FIG. 6
FIG. 6 illustrates an example of elements of an SAOC system in accordance with prior art.
Figure 7:
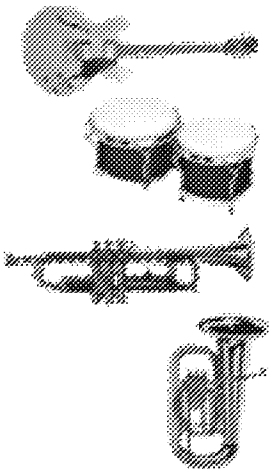
FIG. 7 Prior Art
FIG. 7 illustrates an example of the principle of audio encoding of 3DAA in accordance with prior art.
Figure 7:
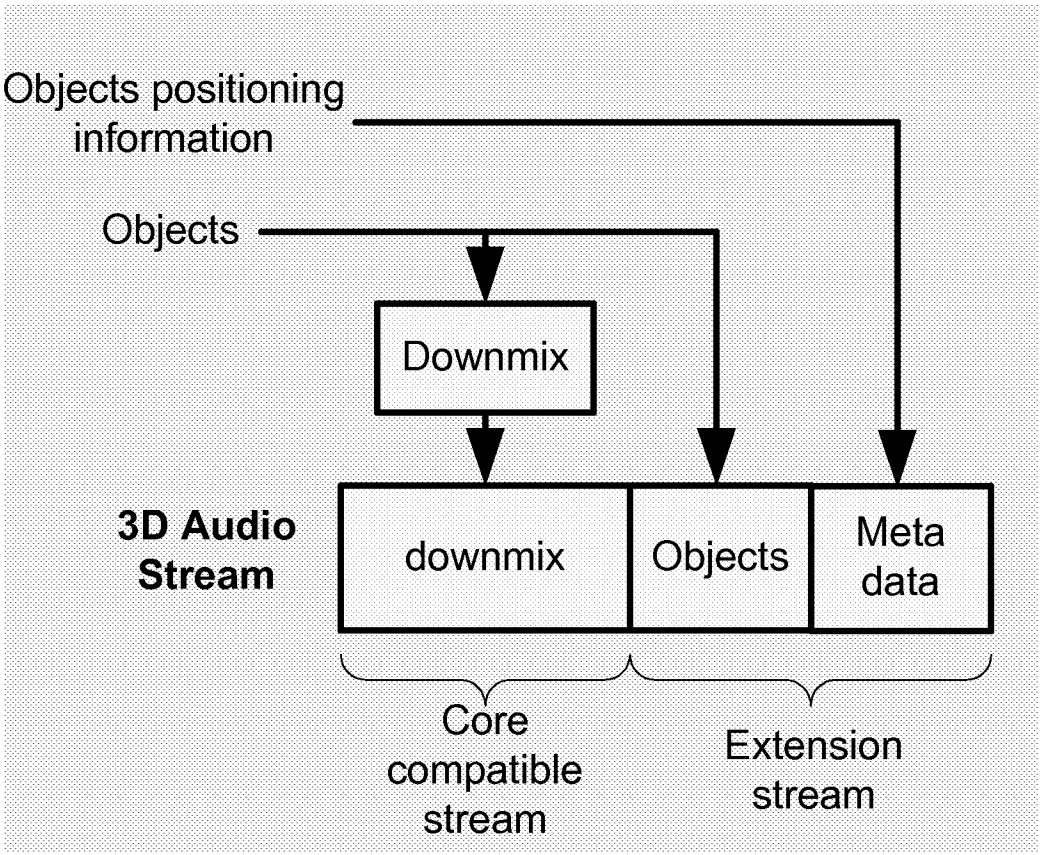
FIG. 7 Prior Art
Figure 8:
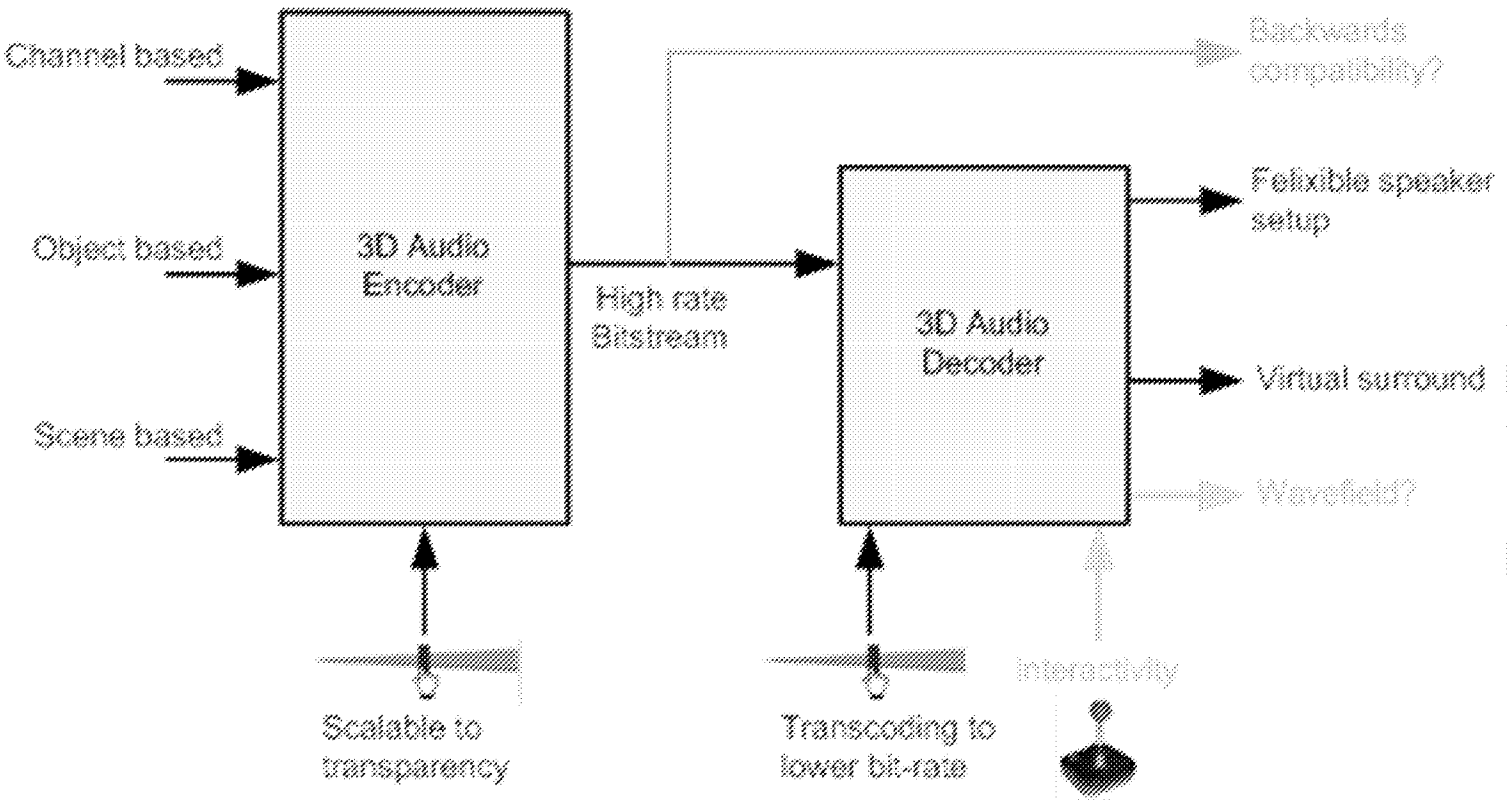
Prior Art FIG. 8
FIG. 8 illustrates an example of elements of an MPEG 3D Audio system in accordance with prior art.
Figure 9:
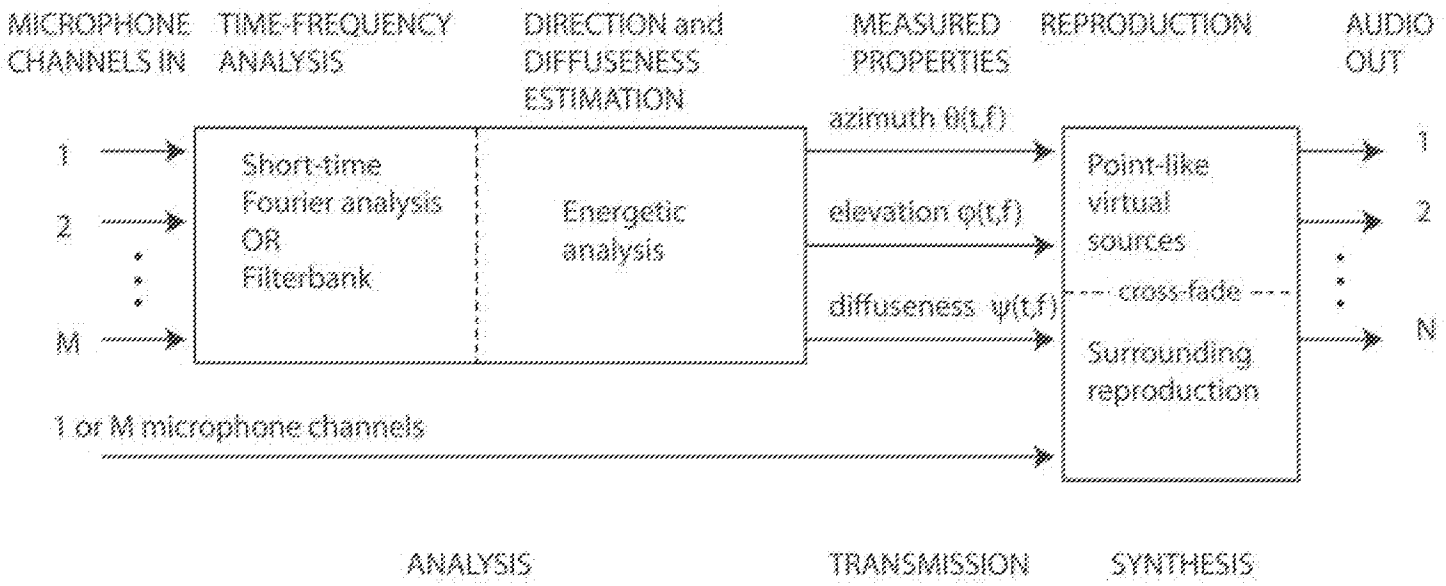
Prior Art FIG. 9
FIG. 9 illustrates an example of elements of an DirAC system in accordance with prior art.
Figure 10:
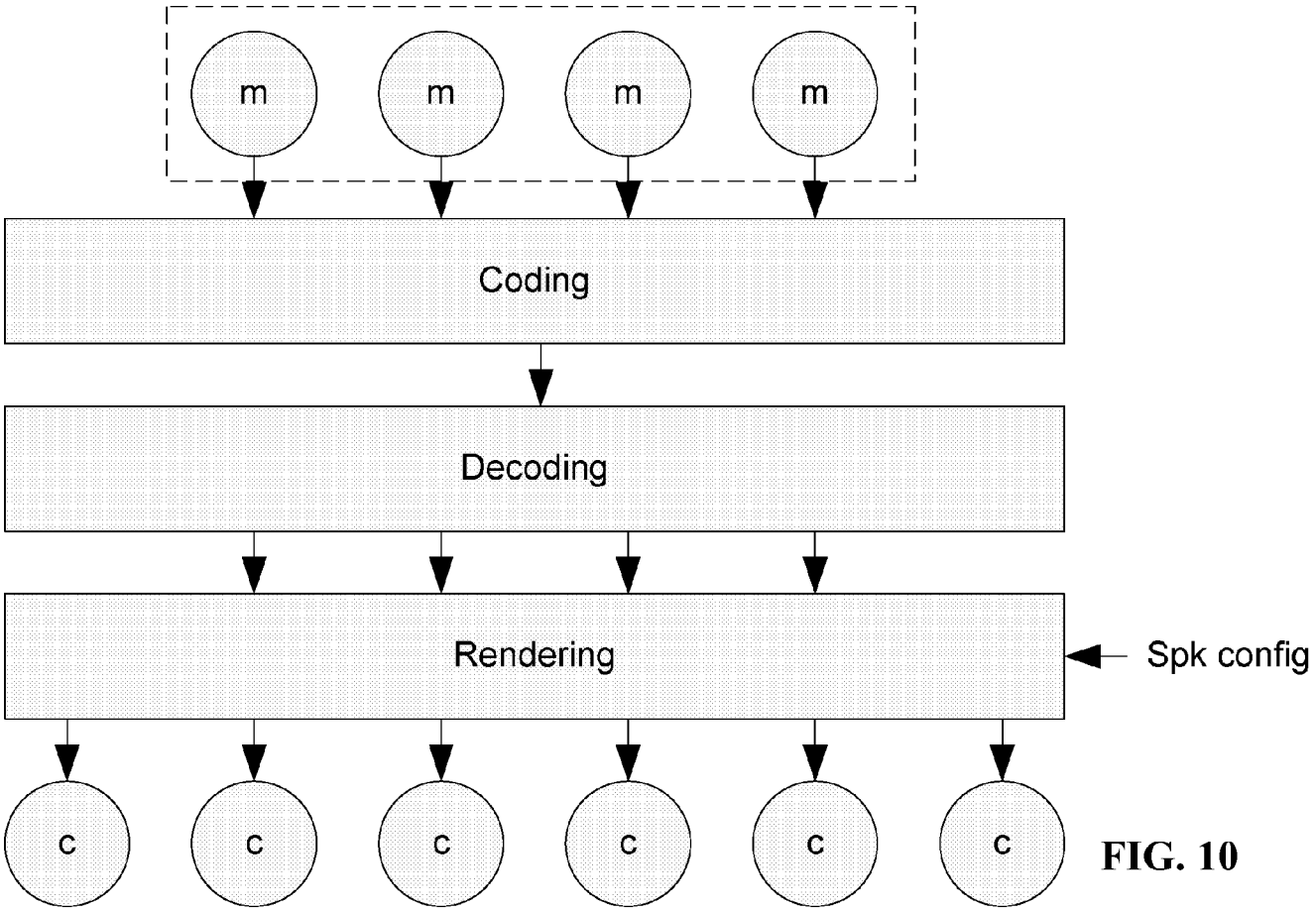
FIG. 10 Prior Art
FIG. 10 illustrates an example of elements of an DirAC system in accordance with prior art.
Figure 11:
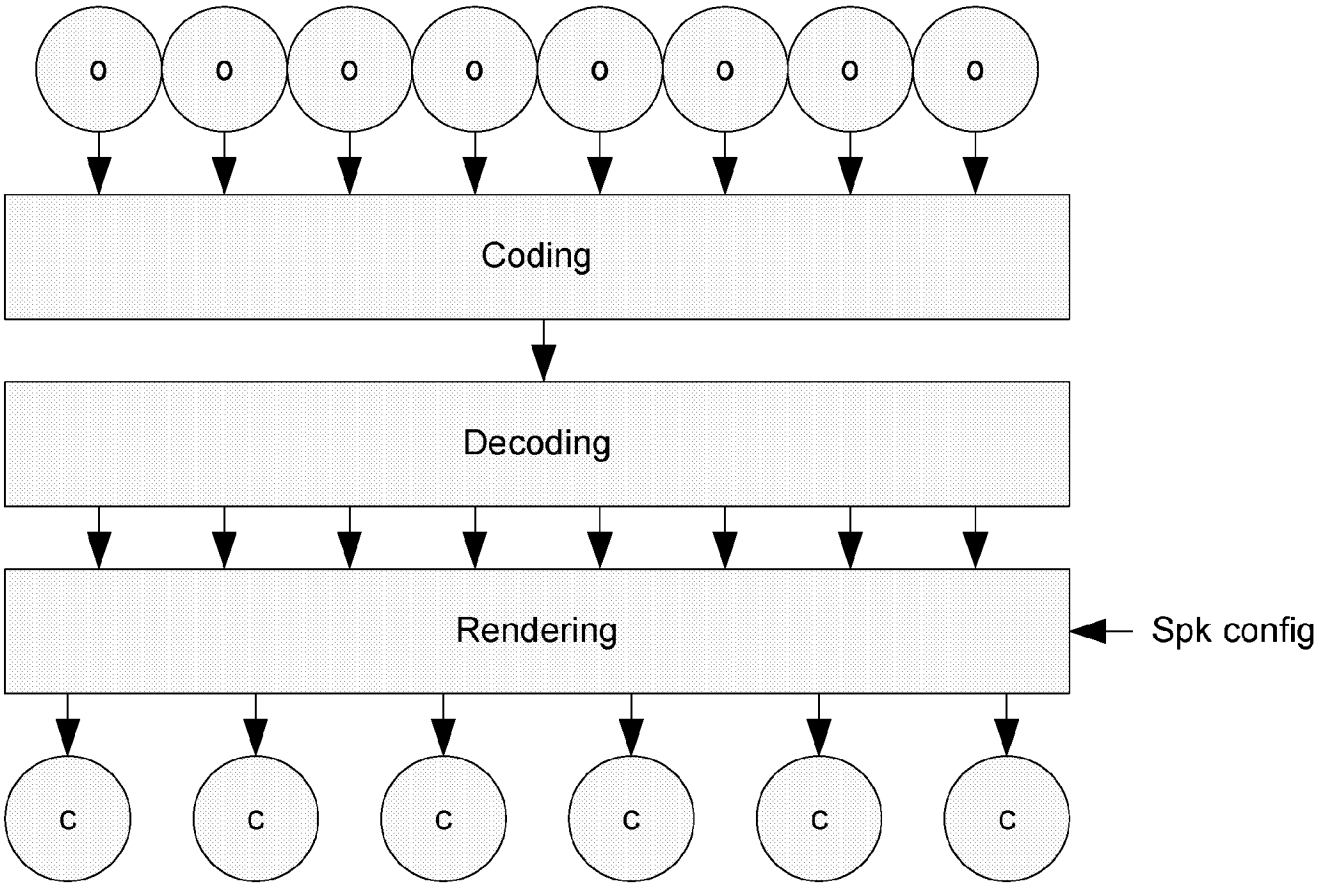
FIG. 11 Prior Art
FIG. 11 illustrates an example of elements of an audio system in accordance with prior art.
Figure 12:
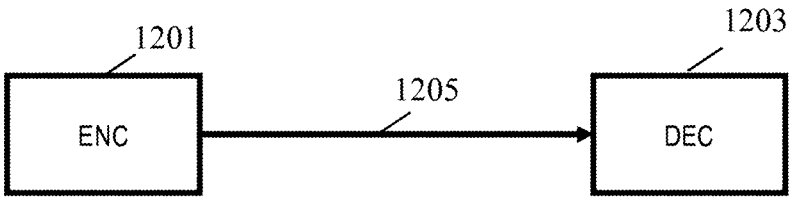
FIG. 12 illustrates an example of elements of an audio system in accordance with some embodiments of the invention.

FIG. 12 illustrates an example of an audio rendering system in accordance with some embodiments of the invention. The system comprises an encoder 1201 which receives audio signals to be encoded. The encoded audio data is transmitted to a decoder 1203 via a suitable communication medium 1205.

The audio signals provided to the encoder 1201 may be provided in different forms and generated in different ways. For example, the audio signals may be audio captured from microphones and/or may be synthetically generated audio such as for example for computer games applications. The audio signals may include a number of components that may be encoded as individual audio objects, such as e.g. specific synthetically generated audio objects or microphones arranged to capture a specific audio source, such as e.g. a single instrument.

Each audio object typically corresponds to a single sound source. Thus, in contrast to audio channels, and in particular audio channels of a conventional spatial multichannel signal, the audio objects typically do not comprise components from a plurality of sound sources that may have substantially different positions. Similarly, each audio object typically provides a full representation of the sound source. Each audio object is thus typically associated with spatial position data for only a single sound source. Specifically, each audio object may typically be considered a single and complete representation of a sound source and may be associated with a single spatial position.

Audio objects are not associated with any specific rendering configuration and are specifically not associated with any specific spatial configuration of sound transducers/speakers. Thus, in contrast to sound channels which are associated with a rendering configuration such as a specific spatial speaker setup (e.g. a surround sound setup), audio objects are not defined with respect to any specific spatial rendering configuration.

An audio object is thus typically a single or combined sound source treated as an individual instance, e.g. a singer, instrument or a choir. Typically, the audio object has associated spatial position information that defines a specific position for the audio object, and specifically a point source position for the audio object. However, this position is independent of a specific rendering setup. An object (audio) signal is the signal representing an audio object. An object signal may contain multiple objects, e.g. not concurrent in time.

In contrast, an audio channel is associated with a nominal audio source position. An audio channel thus typically has no associated position data but is associated with a nominal position of a speaker in a nominal associated speaker configuration. Thus, whereas an audio channel is typically associated with a speaker position in an associated configuration, an audio object is not associated with any speaker configuration. The audio channel thus represents the combined audio that should be rendered from the given nominal position when rendering is performed using the nominal speaker configuration. The audio channel thus represents all audio sources of the audio scene that require a sound component to be rendered from the nominal position associated with the channel in order for the nominal speaker configuration to spatially render the audio source. An audio object in contrast is typically not associated with any specific rendering configuration and instead provides the audio that should be rendered from one sound source position in order for the associated sound component to be perceived to originate from that position.

The spatial audio encoding device 1201 is arranged to generate an encoded signal which contains encoded data that represents the audio signals (specifically audio objects and/or audio channels) provided to the spatial audio encoding device 1201.

The encoded audio stream may be communicated through any suitable communication medium including direct communication or broadcast links. For example, communication may be via the Internet, data networks, radio broadcasts etc. The communication medium may alternatively or additionally be via a physical storage medium such as a CD, Blu-Ray™ disc, memory card etc.

The following description will focus on encoding of audio objects, but it will be appreciated that the described principles as appropriate may also be applied to e.g. audio channel signals.

Figure 13:
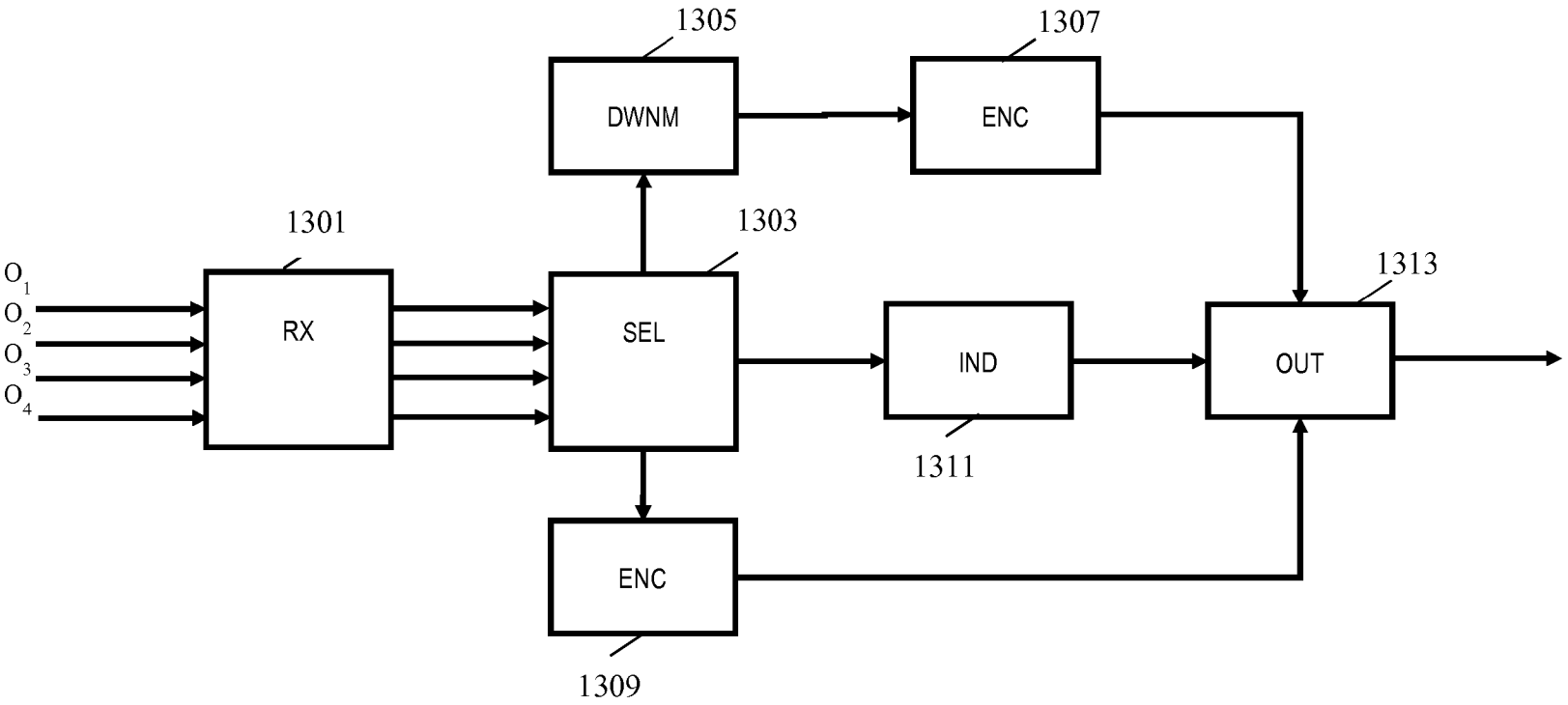
FIG. 13 illustrates an example of elements of an encoder in accordance with some embodiments of the invention.

FIG. 13 illustrates elements of the encoder 1201 in more detail. In the example, the encoder 1201 receives a plurality of audio signals which in the specific example are audio objects (in the specific example four audio objects $O_1$ to $O_4$ are shown but it will be appreciated that these merely represent any plurality of audio objects).

The audio objects are received by an encode receiver 1301 which provides time-frequency tiles for the audio objects to the remaining parts of the encoder 1201. As will be known to the skilled person, a time-frequency tile for a signal corresponds to the signal in a given time interval and a given frequency interval. Thus, representing a signal in time-frequency tiles means that the signal is represented in a number of tiles where each tile has an associated frequency interval and an associated time interval. Each time-frequency tile may provide a single (typically complex) value reflecting the signal value in the associated time interval and frequency interval. However, time-frequency tiles may also provide a plurality of signal values. A signal is often divided into uniform time-frequency tiles, i.e. the time and/or frequency interval is often of the same size for all time-frequency tiles. However, in some scenarios or embodiments, non-uniform time-frequency tiles may be used, e.g. by using time-frequency tiles for which the size of the frequency interval increases for increasing frequencies.

In many embodiments, the audio signals may already be provided to the encoder as time-frequency tile representations. However, in some embodiments, the encode receiver 1301 may generate such representations. This may typically be done by segmenting the signals into time segments (e.g. of a 20 msec duration) and performing a time to frequency transform such as an FFT on each segment. The resulting frequency domain values may each directly represent a time-frequency tile, or in some cases a plurality of adjacent frequency bins (adjacent in time and/or frequency) may be combined into a time-frequency tile.

For brevity, the following description will refer to time-frequency tiles using the abbreviated term of "tiles".

The encode receiver 1301 is coupled to a selector 1303 which receives the tiles of the audio objects. The selector 1303 is then arranged to select some tiles that will be encoded as downmixed tiles and some tiles that will be encoded as non-downmixed tiles. The downmixed tiles will be tiles that are generated by downmixing at least two tiles typically from at least two audio objects whereas non-downmix tiles will be encoded without any downmixing. Thus, the non-downmix tiles will comprise data from only one tile of the audio objects/signals being encoded. Thus, a non-downmix tile will include a contribution from only one audio object whereas downmix tiles will include components/contribution from at least two tiles and typically at least two audio objects. A non-downmix tile is specifically a tile that is not a downmix of two or more tiles.

The selector 1303 is coupled to downmixer 1305 which is fed the tiles selected by the selector 1303. It then proceeds to generate a downmix tile from these tiles. For example, two corresponding (same frequency interval and time interval) tiles from different audio objects that are intended to be downmixed are by the downmixer 1305 downmixed to generate a single downmixed tile. This approach is performed for the plurality of tiles thereby generating a set of downmixed tiles, where each downmix tile represents at least two tiles and typically from at least two audio objects.

In many embodiments, the downmixer 1305 further generates parametric (upmix) data which can be used to recreate the original audio object tiles by performing an upmixing of the downmix tiles. For example, the downmixer 1305 may generate Inter-object Level Difference (ILD), Inter-object Time Difference (ITD), Inter-object Phase Differences (IPD), and/or Inter-object Coherence Coefficients (ICC) as will be well known to the person skilled in the art.

The downmix tiles are fed to a first encoder 1307 which proceeds to encode each downmix tile to generate an encoded downmix tile. The encoder may for example be a simple quantization of the values of the downmix tiles, and may specifically be an encoding which maintains the waveform represented by the downmix tile.

In many embodiments, the upmix parameters may also be provided to the first encoder 1307 which may encode these using any suitable encoding approach.

The selector 1303 is furthermore coupled to a second encoder 1309 which is fed the tiles that are to be non-downmix tiles. The second encoder then proceeds to encode these tiles.

It will be appreciated that although FIG. 13 illustrates the first and second encoder 1307, 1309 as separate functional units, they may be implemented as a single encoder and the same encoding algorithm may be applied to both downmix tiles and non-downmix tiles.

It will be appreciated that any encoding of the downmix and non-downmix tiles may be used to generate a suitable encoded data signal. For example, in some embodiments all tiles may be separately encoded. E.g., individual encoding may be performed for each tile without consideration or impact from any other tiles, i.e. the encoded data for each tile may be generated independently of other tiles. As a specific example, a quantization and channel coding may be performed separately for each tile (whether downmix or non-downmix) to generate data that is combined to generate the encoded data.

In other embodiments, some joint encoding of tiles may be used. Specifically, a selection of downmix tiles and/or non-downmix tiles may be encoded jointly to improve efficiency by exploiting specific properties and/or correlation of the tiles and/or the objects represented by the tiles.

The selector 1303 is furthermore coupled to an indication processor 1311 which receives information of which tiles are encoded as downmix tiles and which are non-downmix. The indication processor 1311 then proceeds to generate a downmix indication that indicates whether the tiles of audio objects are encoded as downmixed tiles or as non-downmix tiles. The downmix indication may for example comprise data for each tile of each of the audio objects where the data for a given tile indicates whether this has been non-downmix or encoded as a downmix. In the latter case, the data may further indicate which other audio objects are downmixed into the same downmix. Such data may allow the decoder to identify which data of the encoded data signal should be used to decode a specific tile.

The first encoder 1307, the second encoder 1309, and the indication processor 1311 are coupled to an output processor 1313 which generates an encoded audio signal that includes the non-downmix tiles, the downmix encoded tiles, and the downmix indication. Typically, the upmix parameters are also included.

Figure 14:
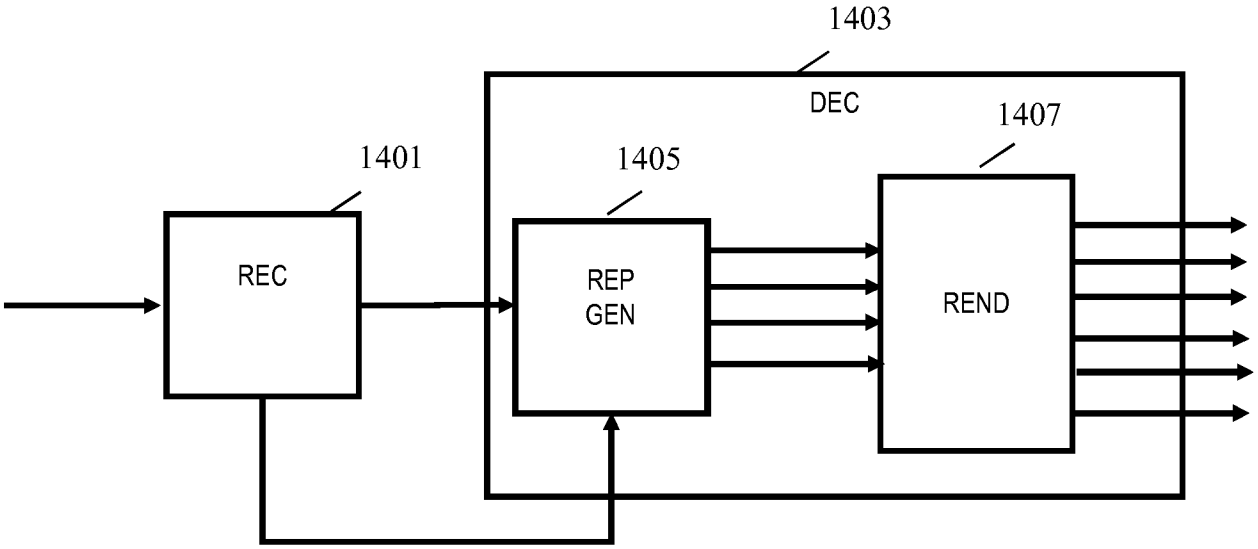
FIG. 14 illustrates an example of elements of a decoder in accordance with some embodiments of the invention.

FIG. 14 illustrates elements of the decoder 1203 in more detail.

The decoder 1203 comprises a receiver 1401 which receives the encoded signal from the encoder 1201. Thus, the receiver receives an encoded data signal that represents the plurality of audio objects, with the encoded data signal comprising encoded tiles that are either coded as downmix tiles or as non-downmix tiles. Furthermore, it includes the downmix indication that indicates how the separation of the original audio tiles into the different types of encoded tiles has been performed. Typically, the upmix parameters are also included.

The receiver 1401 is coupled to a generator 1403 which is fed the received tiles and the downmix indicator, and which in response proceeds to generate a set of output signals. The output signals may for example be the decoded audio objects which may then be processed or otherwise manipulated in a post processing operation. In some embodiments, the generator 1403 may directly generate output signals that are suitable for rendering using a given rendering setup (and specifically speaker configuration). Thus, the generator 1403 may in some scenarios comprise functionality for mapping the audio objects onto audio channels of a specific rendering configuration.

The generator 1403 is arranged to process encoded tiles differently according to whether they are downmix tiles or non-downmix tiles. Specifically, for tiles that are indicated by the downmix indication to be downmix tiles, the generation of tiles for the output signals comprises an upmixing operation. Thus upmixing operation may specifically correspond to an extraction or reproduction of a tile for an audio object from a downmix tile in which the audio object tile has been downmixed.

In embodiments where the data signal includes parametric upmix data, this data is used in the upmixing operation of the downmixed tiles.

As an example, the generator 1403 may comprise a reproduction generator 1405 which reproduces the original audio objects. The reproduction generator 1405 may for example process each audio object one at a time, and with each audio object being processed one tile at a time.

E.g. the reproduction generator 1405 may for a given (time) segment start with tile 1 (e.g. the lowest frequency tile) of audio object 1. The downmix indication is then evaluated for tile 1 for object 1. If the downmix indication indicates that the encoded tile for tile 1 of object 1 is non-downmix, the encoded tile is decoded to directly provide tile 1 of object 1. However, if the downmix indication indicates that the encoded tile for tile 1 of object 1 is downmix encoded, the encoded tile is first decoded to provide the downmix tile and consecutively upmixed to reproduce the original tile 1 of audio object 1. This upmixing of the (encoded) downmix tile thus creates an (estimate) of tile 1 of audio object 1 prior to it being downmixed at the encoder. The upmixing may specifically use the parametric upmix data if such data is available. However, if no such data is provided, the upmixing may be a blind upmixing. The result of the upmix operation applied to encoded tile 1 of object 1 is thus (an estimate of) tile 1 of audio object 1 as fed to the encoder 1201.

Thus, the result of the operation is tile 1 of object 1 where the generation of the tile depends on whether the downmix indication indicates that this has been encoded as a downmix or as a non-downmix tile.

The reproduction generator 1405 then proceeds to perform the exact same operation for tile 2 of audio object 1, thereby resulting in a decoded tile 2 of audio object 1.

The process is repeated for all tiles of audio object 1 and the resulting collection of generated tiles thus provides a time-frequency tile representation of audio object 1. This may be output by the reproduction generator 1405 (or the generator 1403), or if e.g. a time domain signal is required, a frequency to time domain transformation may be applied (e.g. an iFFT).

The same approach is then repeated for audio object 2, then audio object 3 etc. until all audio objects have been generated.

It will be appreciated that in this example, multiple upmix operations are applied to each encoded downmix tile. For example, if a given encoded downmix tile is a downmix of, say, tiles of audio object 1 and 3, an upmix operation will be performed both when audio object 1 is generated and when audio object 3 is generated. The upmix operations will use different upmix parameters (specifically the parameters that are provided for the specific object).

It will be appreciated that in some embodiments, the upmixing may simultaneously provide both (or all) of the upmixed tiles. For example, a matrix operation may be used to directly generate the upmixed tiles for both audio object 1 and 3. The total upmix operation may for example be performed when the algorithm first encounters a given encoded downmix tile (e.g. when processing object 1). The resulting upmixed tiles for other objects may be stored such that no separate upmix operation is required when the other tiles downmixed into the encoded downmix tile are encountered (e.g. when processing object 3 in the specific example).

It will be appreciated that in some embodiments or scenarios, only one upmixed tile may be generated from one encoded downmix tile by the upmixing operations of the reproduction generator 1405. For example, if only object 1 is generated by the reproduction generator 1405, the upmixing of a given downmix tile only needs to provide the upmixed tile for object 1.

In some embodiments, the decoded audio objects may be directly output from the generator 1403. However, in the example of FIG. 14, the decoded audio objects are fed to a rendering processor 1407 which are arranged to generate output signals corresponding to a specific rendering setup, and specifically to a specific speaker configuration. The rendering processor 1407 may thus map the audio objects to output channels where each output channel is associated with a nominal sound rendering position. For example, a number of audio objects may be mapped to the audio channels of a 5.1 surround sound speaker setup.

The person skilled in the art will be aware of different algorithms for mapping audio objects on to audio channels for specific spatial speaker configurations, and it will be appreciated that any suitable approach may be used.

In the example of FIG. 14, the generator 1403 is shown to have separate functionality for generating the audio objects and for rendering these. However, in many embodiments, the functionality of the reproduction generator 1405 and the rendering processor 1407 may be combined into a single integrated function or operation. Thus, the generator may directly generate the rendering output from the encoded data without generating the audio objects as explicit intermediate signals.

For example, the upmixing operation may be performed as a matrix operation/multiplication (or even as a complex multiplication if only one upmix value is to be generated). Similarly, the rendering mapping may be performed as a matrix operation/multiplication). One or more matrix operations/multiplications may specifically be a vector operation/multiplication (i.e. using a matrix with only one column or row). It will be appreciated that the two sequential multiplications may be combined into a single matrix multiplication applied to the tile values of the encoded tiles. This can be achieved by the matrix multiplication having matrix coefficients that reflect both the upmixing (if performed) and the rendering mapping. Such a matrix may e.g. be generated simply by multiplying the individual matrices associated with the upmixing and rendering mapping. Thus, in such a scenario, the upmixing is performed as an integral part of a single matrix operation and without requiring an explicit generation of the upmix tile values or the audio objects as intermediate signals. In such embodiments, the matrix coefficients may thus reflect/include an upmixing for tiles that are indicated to be downmix tiles but not for tiles that are indicated to be non-downmix tiles. Specifically, the matrix coefficients may depend on upmix parameters received in the encoded data signal when the downmix indication indicates that the tile is downmix tile but not when it indicates that the tile is a non-downmix tile.

Figure 15:
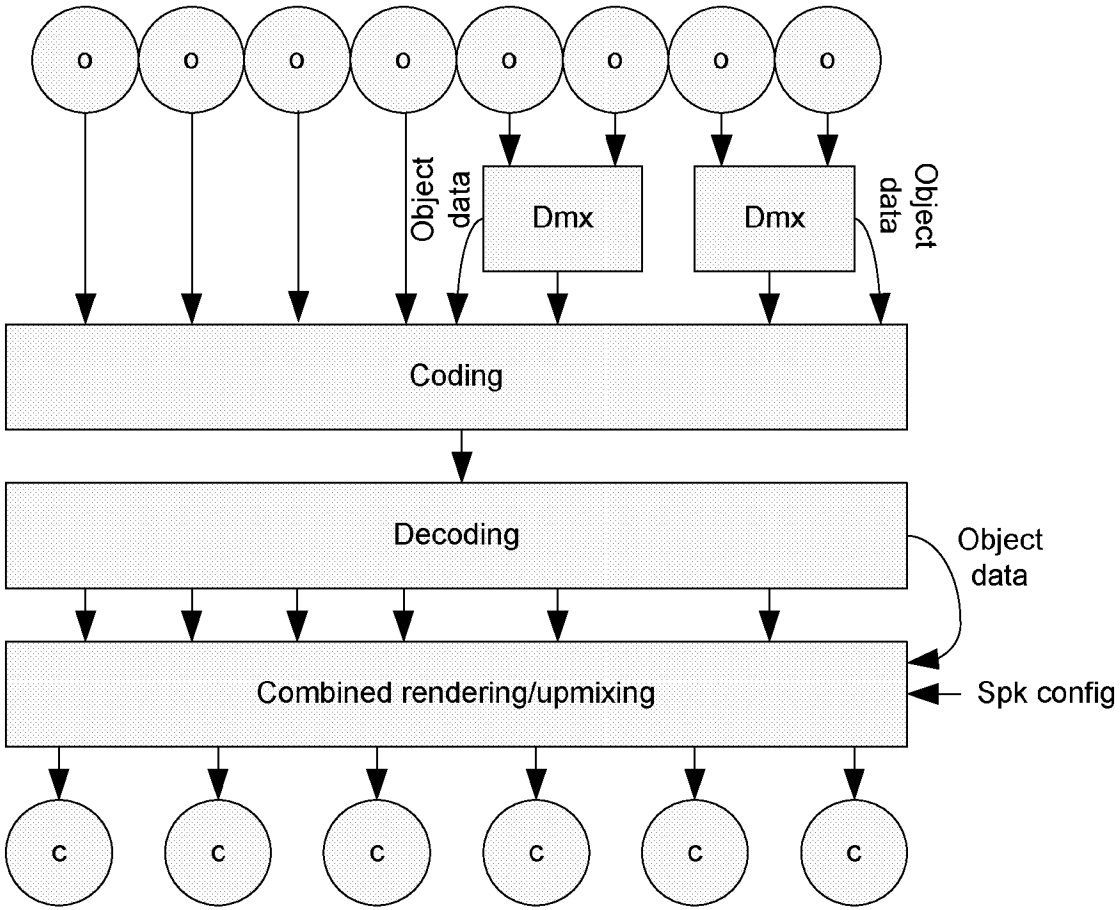
FIG. 15 illustrates an example of elements of an audio system decoder in accordance with some embodiments of the invention.

The approach of the system of FIG. 12 may be illustrated by FIG. 15. As illustrated, a subset of audio objects is provided directly for coding and is encoded as non-downmix tiles, i.e. without any downmixing. However, audio objects of another subset (disjoint with the first subset) are not provided directly for encoding but are first combined with other audio objects in a downmix. In the example, four audio objects are pairwise downmixed to two downmixes. The downmix furthermore generates parametric upmix data (object data) which describes/defines how the original audio objects may be generated from the downmix. It will be appreciated that such parameters may be provided for longer time intervals etc., and that the downmix and parametric data accordingly provides a data reduction in comparison to the original signals. The downmixes are then coded together with the parametric data. At the decoder side, the coding may first be undone to generate the signal values for the non-downmix signals and for the upmixes. The resulting signals are then processed to generate suitable output channels. This processing includes upmixing for the downmixes (based on the parametric upmix data) and a mapping of the audio objects to the specific speaker configuration.

In the system, the signals are processed in a time-frequency tile representation, and specifically by processing in the time-frequency tile domain. Furthermore, a downmix indication is provided which may for individual tiles indicate whether the individual audio object tiles are encoded as downmix tiles or as non-downmix tiles. This downmix indication is communicated from encoder to decoder and accordingly allows the allocation of tiles as downmix or non-downmix tiles to be performed on a tile per tile basis. Thus, FIG. 15 may be considered to represent the approach for a specific tile, i.e. for a specific time and frequency interval. However, for other tiles, the same audio objects may be encoded using a different allocation of tiles into downmix encoded and non-downmix tiles. Thus, the system may provide a very flexible encoding, and the highly granular approach may allow substantial optimisation for a given target rate with the optimisation being specific for the specific signal characteristics.

The approach allows for a very efficient trade-off between the relative merits of downmix encoding and non-downmix encoding (and thus between the relative merits of parametric encoding and waveform encoding). For example, for lower data rates, a relatively large number of tiles may be parametrically encoded as downmix tiles with associated parameters. However, it is still possible to encode critical tiles without any downmixing thereby reducing the possible quality degradation of parametric encoding. As the target/available data rate is increased, an increasing number of tiles may be non-downmix tiles thereby increasing the quality (specifically the audio objects are increasingly waveform encoded rather than parametrically encoded and in particular audio object cross talk may be reduced). This trend may be continued until all tiles are non-downmix tiles and the entire encoding and decoding approach becomes transparent. Thus, a highly efficient encoding and scalability to transparency can be achieved.

The system of FIG. 12 may thus be seen as a hybrid waveform/parametric approach which uses pre-combining of a subset of the available tiles into downmixed tiles along with accompanying parametric information. The remaining tiles together with the downmixed tiles may be coded using traditional waveform coding tiles. The parametric information will relate the downmixed tiles to the audio object tiles. In addition, information about how each object is represented (purely waveform or waveform plus parametric information—i.e. whether non-downmix or downmix encoded) is also conveyed in the encoded data signal. These features in particular allow an improved scalability of the data rate of the encoded signals.

One particular example is the coding of a diffuse sound field. Under the assumption that the diffuse sound field is indeed omnidirectional, this requires a virtually unlimited number of objects to represent the diffuse sound field. Typically, due to limitations of the human auditory system, it is not needed to represent the diffuse sound field using a very large amount of objects/channels. Depending on the available bit rate, the high number of objects/channels that represent the diffuse sound field can be downmixed into a lower number of objects/channels with accompanying parametric information.

In the example of FIG. 15, eight objects are encoded. The encoder determines which object tiles are to be combined into downmixed tiles. In addition to the downmix, object data, representing the relation between the downmixed tiles and the original object tiles is also derived. Information on how each tile of the original objects can be derived (direct waveform or downmix waveform plus object data) is also derived. The resulting information, consisting of object tiles that have not been downmixed, object tiles that have been (partially) downmixed with their accompanying object data, and the derivation information (the downmix indication) are all coded. The object tiles (whether downmixed or not) may be coded using traditional waveform coding techniques.

The decoder receives one or more downmix tiles where each downmix tile represents a downmix of one or more tiles from one or more of the audio objects. In addition, the decoder receives parametric data associated with the object tiles in the downmix tiles. Also, the decoder receives one or more tiles from one or more of the object signals with these tiles not being present in the downmix tiles. The decoder further receives a downmix indicator which provides information that is indicative of whether a given object tile is encoded as a non-downmix tile or as a downmix tile with parametric data. Based on this information, the decoder can generate tiles for output signals using either downmix tiles plus parametric information or using non-downmix tiles.

In some embodiments, all operations are performed on corresponding tiles, i.e. the processing is performed separately for each tile's frequency interval and time interval. Specifically, the output signal is generated by generating an output signal tile based on encoded tiles that cover the same time and frequency interval. However, in some embodiments, some frequency or time transformation may be performed as part of the processing. For example, a plurality of encoded tiles may be combined to generate an output tile covering a larger frequency interval.

Also, typically the downmixing will be of tiles covering the same frequency interval and time interval. However, in some embodiments, the downmix may be of tiles covering different intervals which may be overlapping or disjoint. Indeed, in some embodiments and scenarios, a downmix may even be of two tiles of the same signal (e.g. two tiles being adjacent along the frequency dimension).

The use and communication of a downmix indication provides for a very high degree of flexibility in the encoding of the audio objects and specifically in the selection of how to combine (or not) audio objects as part of the encoding process. The approach may allow individual signal segments (individual tiles) to be flexibly selected for combination with other signal segments depending on characteristics of only part of the signal. Indeed, rather than merely selecting which signals or objects can be downmixed together, the application of a tile based downmix indication allows such considerations to be performed for individual signal segments and specifically for individual tiles.

In some embodiments, the downmix indication may include a separate indication for each tile of each object, and the encoder may for each tile determine if the tile is downmixed, and if so it may decide which other tile or tiles the downmixing should be with. Thus, in such embodiments, an individual tile based optimization of the downmixing may be performed for all objects. Indeed, a global optimization process may be performed to achieve the highest audio quality for a given target rate.

The approach may specifically allow some tiles of a given object to be downmixed with other tiles, whereas other tiles of the object are encoded without any downmixing. Thus, the encoding of one object may include both downmixed tiles and non-downmix tiles. This may substantially improve the encoding efficiency and/or quality.

For example, two audio objects may in a given time segment contain some frequency intervals which are perceptually less important (e.g. due to low signal values) whereas other frequency intervals are perceptually more important. In this case, the tiles in the less perceptually significant intervals may be downmixed together whereas the more perceptually significant intervals are kept separate to avoid cross talk and improve quality.

Also, it will be appreciated that the objects that are involved in different downmixes may be varied. For example, for a given object, one tile may be downmixed with one other object whereas another tile may be downmixed with another object. As a specific example, for lower frequencies it may be advantageous to downmix objects 1 and 2 whereas for higher frequencies, it may be advantageous to downmix objects 1 and 3 (say in an example where object 1 has low signal energy at both high and low frequencies, object 2 has low signal energy at low frequencies but high signal energy at high frequencies, and object 3 has low signal energy at high frequencies but high signal energy at low frequencies).

The number of tiles being downmixed into a given downmix tile is furthermore in many embodiments not limited to two tiles, but indeed in some embodiments and scenarios one or more downmix tiles may be generated by downmixing 3, 4 or even more tiles.

The flexibility further extends in the time direction and indeed the distribution of tiles into downmix and non-downmix tiles may be temporally varying. The distribution may thus be dynamically changed, and in particular a new distribution/allocation may be determined for each time segment.

It will also be appreciated that it is not necessarily required that all objects include one or more tiles that are downmixed. Indeed, it is possible that all tiles of one or more of the objects may be non-downmix tiles thereby providing a high audio quality of these objects. This may be particularly appropriate if one object is of specific perceptual significance (such as the vocals for a music audio scene). Likewise, it is possible that all tiles of one or more audio objects are entirely encoded as downmix tiles.

Figure 16:
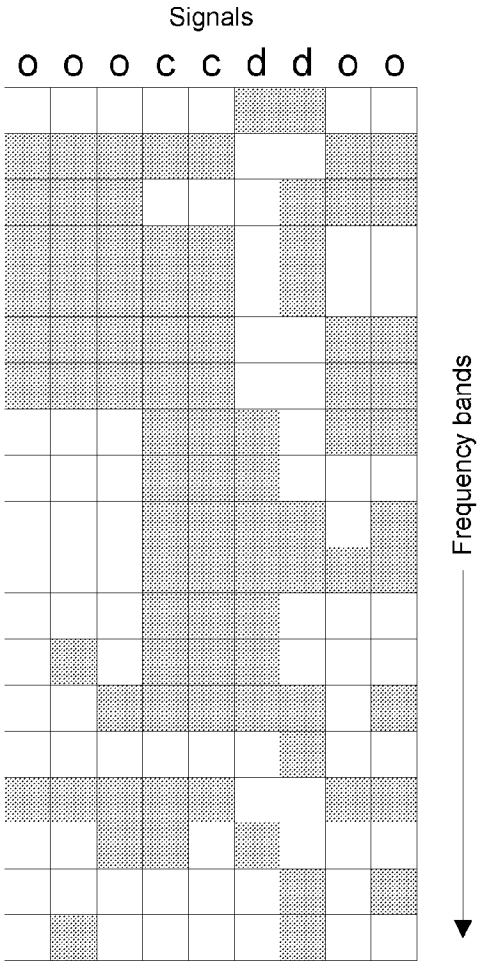
FIG. 16 illustrates an example of encoding of time-frequency tile of audio signals as downmix or non-downmix time-frequency tiles in accordance with some embodiments of the invention.

An example of the possible flexibility is illustrated in FIG. 16, which shows the distribution of tiles in one time segment. In FIG. 16, each column consists of the tiles of a given audio input signal and each row is a specific frequency interval (corresponding to the tiles). The example illustrates five audio objects (represented by the letter o) and two audio channel signals (represented by the letter c). In addition, the example is based on an encoding of the segment which for each frequency interval may include two downmixes (represented by the letter d).

In the example, the first frequency interval (i.e. the first row) is encoded using only two downmix tiles. Specifically, in this interval, the tiles of the three leftmost objects and the two audio channels may be combined into the first downmix and the tiles of the two rightmost objects may be combined into the second downmix tile.

In the next frequency interval/row, all tiles are encoded as non-downmix tiles. In the next frequency interval/row, the two tiles of the two audio channels are downmixed into one downmix tile whereas all object tiles are coded as non-downmix tiles. In the next frequency interval/row, the two tiles of the two rightmost objects are downmixed into one downmix tile whereas all other tiles are coded as non-downmix tiles. Etc.

For efficient coding of the resulting signals/tiles, existing techniques for sparse matrix storage may e.g. be used. Additionally or alternatively, various techniques can be employed to improve bitrate efficiency in the coding of the tiles. For example, the quantization level for a given object/tile can be increased due to spatial masking by other objects/tiles in the scene. In extreme cases, a given tile may e.g. not be transmitted at all (i.e. quantized to zero).

It will be appreciated that different approaches, algorithms or criteria can be used for selecting which tiles are downmixed (and into which downmixes).

In many embodiments, the selector 1303 may select tiles for downmixing in response to a target data rate for the encoded audio signal. In particular, the number of tiles that are downmixed and/or the number of downmixes that are included in the encoded audio signal may be dependent on the available (i.e. the target) data rate. Thus, for lower data rates, a relative large number of downmixes are generated. As the target data rate increases, the number of downmixes is reduced, and indeed if the data rate is sufficiently high, the system may select not to perform any downmixes. At extremely low bitrates the number of downmixes may be small but each downmix may be a downmix of a high number of tiles. Thus, a relatively low number of downmixes may represent most (if not all) frequency tiles of the plurality of audio signals.

The selector 1303 may (also) perform the selection in response to the energy of the tiles. Specifically, tiles that represent lower energy of the signal component in the tile may be downmixed whereas tiles that represent higher energy of the signal component in the tile may be encoded as a non-downmix tile. A lower energy is likely to be less perceptually significant and therefore the implications (such as cross talk) of the downmix encoding may be reduced accordingly. In some scenarios, it may be advantageous to balance the energy of the tiles that are combined in a given downmix. This may for example reduce cross talk as the signals will be more similar in the given tile.

In some embodiments, the selection may be in response to spatial characteristics of the tiles. For example, the audio object may represent audio objects that are likely to be positioned close to each other and accordingly these tiles may be selected to be downmixed together. In many embodiments, objects that are spatially nearby will be combined. The rationale for this is that the more spatial separation is required between objects, the more spatial unmasking will occur. In particular, cross talk is less likely to be perceived when it is between two close audio sources than when it is for two audio sources which are spatially far from each other.

In some embodiments, the selection may be in response to a coherence characteristic between pairs of the tiles. Indeed, cross talk between signals that are closely correlated is less likely to be perceived than between signals that are only very loosely correlated.

It will be appreciated that the specific representation of information by the downmix indication may depend on the specific requirements and preferences of the individual embodiments.

As an example, a predetermined restriction may be that the audio objects can only be downmixed together in certain pairs. For example, tiles of object 1 can only be downmixed with tiles (in the same frequency and time interval) of object 2, tiles of object 3 can only be downmixed with tiles of object 4 etc. In such a case, the downmix indication may simply indicate which tiles are downmixed and need not explicitly indicate the identity of tiles that are downmixed in a specific downmix. For example, the downmix indication may include one bit for each frequency interval of object 1 and 2 where the bit simply indicates whether the tile is downmixed or not. The decoder may interpret this bit and perform an upmixing of the tile to generate tiles for objects 1 and 2 if the bit indicates that the tile is a downmix.

Indeed, the downmix indication need not be explicit but may be provided by other data. In particular, for embodiments where the downmix generates parametric data, the indication that a tile is a downmix tile may simply be provided by the presence of parametric upmix data. Thus, if parameters describing how to generate upmix tile(s) from an encoded tile is provided in the audio signal, this provides an indication that the tile is indeed a downmix tile.

In many embodiments, the downmix indication may indicate which object tiles are downmixed in a given downmix tile. The downmix indication may for one or more (possibly all) tiles that are encoded as downmix tiles provide a link between the downmix tile and the tiles of the audio objects. The link may identify the tiles that are downmixed in the downmix. For example, the link data may for a given downmix tile indicate that it is a downmix of, say, objects 1 and 2, for another downmix tile that it is a downmix of, say, objects 2, 4 and 7, etc.

Including identification of object tiles that have been downmixed into downmix tiles may provide increased flexibility and can avoid any need for a predetermined restriction on which tiles may be downmixed. The approach may allow a completely free optimization where tiles of the downmixes may be downmixed in any combination to provide an optimized (perceptual) audio quality for a given data rate.

It will also be appreciated that the downmix indication can be structured differently in different embodiments. In particular, it will be appreciated that the downmix indication data may be provided with reference to the original object tiles (more generally the tiles of the audio signals being encoded). For example, for each tile of each object, the presence of parametric upmix data may indicate that the tile is a downmix tile. For this tile, data is provided which links it to a specific encoded downmix tile. For example, the data may provide a pointer to a data position in the encoded data signal where the corresponding downmix tile has been encoded.

Equivalently, the downmix indication data may be provided with reference to the encoded tiles (and in particular to the encoded downmix tiles of the audio signals). For example, for an encoded tile of the audio signal, the audio signal may include a data section which identifies which objects the downmix tile represents.

It will be appreciated that these approaches are equivalent and that a downmix indication being referenced to the encoded tiles inherently also provides a downmix indication for the object tiles. E.g. it is noted that the information provided by data indicating e.g.

Tile N of object A is downmixed into encoded tile X,

Tile M of object B is downmixed into encoded tile X, (i.e. data referenced to the object tile) provides exactly the same information as data indicating:

Encoded tile X is a downmix of tile N of object A and tile M of object B.

(i.e. data referenced to the encoded tile).

The arrangement of data in the encoded data signal may depend on the specific embodiment. For example, in some embodiments, the data representing the downmix indication may be provided in one data section separate from the encoded data tiles and parametric update. In other embodiments, the data may be interspersed, e.g. with each encoded downmix data tile being accompanied by a field comprising upmix parameters and identification of the object tiles included in the downmix.

For example, the encoded audio signal may be structured by the object signals being arranged sequentially in a data stream. Thus, first data may be provided for object 1. This data may comprise a plurality of sequential data sections each of which represents one tile (e.g. in order of increasing frequency). Thus, the first section includes an encoded tile for tile 1 of object 1, the next section includes an encoded tile for tile 2 of object 1, etc.

If a section comprises an encoded tile that is a non-downmix tile, only the encoded tile data is included in the section. However, if the tile has been encoded as a downmix tile, the section comprises the encoded downmix data, i.e. the downmix tile. However, in addition, the section comprises a field containing parametric upmix parameters for generating the tile for object 1 from the downmix tile. This indicates that the section contains a downmix tile. In addition, a field is included which identifies which other tile(s) is (are) combined into the downmix (e.g. it may contain data indicating that the corresponding tile of object 2 is also represented by the downmix).

The encoded audio signal can thus contain sequential sections for all tiles of the first audio object.

The same approach is then repeated for the next audio object, i.e. following the encoding data for object 1, the encoded data for object 2 is provided in a plurality of sections each of which corresponds to one tile. However, in this case, downmix encoding data that has already been provided in an earlier section (e.g. for a previous object) is not included. For example, if a downmix is generated for tile 2 of objects 1 and 2, this encoded downmix data has already been provided for tile 2 of object 1, and accordingly the data section for tile 2 of object 2 does not contain any encoded data. However, in some embodiments it may comprise the upmix parameters for generating tile 2 of object 2 from the downmix tile. In other embodiments, this data may not be provided (i.e. blind upmixing may be used) or it may be provided with the encoded tile data (i.e. in the data section for tile 2 of object 1). In such embodiments, the current section may be empty or skipped.

This approach may be continued for all objects with the principle that encoded downmix data is included only the first time it is encountered in the sequential tile arrangement of the encoded data signal. The encoded data for each time segment may be provided as described with time segments being arranged sequentially in the encoded audio signal.

It will be appreciated that many other arrangements are possible and that any suitable arrangement may be used.

The above description has focused on encoding of audio objects. However, it will be appreciated that approach is also applicable to other audio signals. Specifically, it may be applicable to encoding of audio signals/channels of a spatial multichannel signal and/or audio signals for channels associated with a nominal position in a nominal speaker configuration. Specifically, the references to audio objects in the previous description may as appropriate be considered to be a reference to audio signals.

Figure 17:
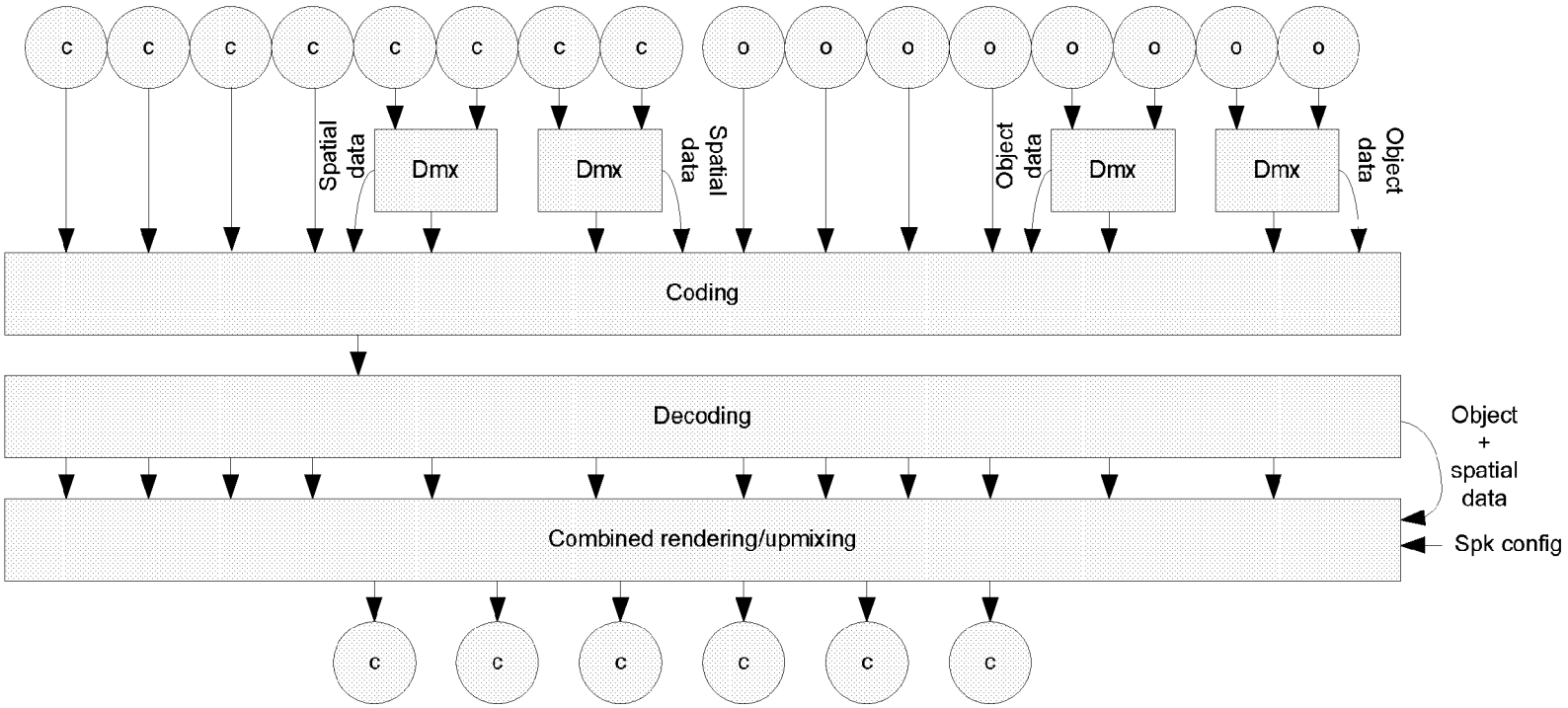
FIG. 17 illustrates an example of elements of an audio system decoder in accordance with some embodiments of the invention.

Indeed, the approach can be used in a hybrid channel/object based system. An example of such is illustrated in FIG. 17. In the example, both audio channels and objects are treated in a similar way as previously described for audio objects. The encoder decides upon which tiles of objects and/or channels are to be combined. This selection can specifically combine tiles of audio channels and objects into (hybrid) downmix tiles.

It will be appreciated that the above description for clarity has described embodiments of the invention with reference to different functional circuits, units and processors. However, it will be apparent that any suitable distribution of functionality between different functional circuits, units or processors may be used without detracting from the invention. For example, functionality illustrated to be performed by separate processors or controllers may be performed by the same processor or controllers. Hence, references to specific functional units or circuits are only to be seen as references to suitable means for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units, circuits and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements, circuits or method steps may be implemented by e.g. a single circuit, unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc do not preclude a plurality. Reference signs in the claims are provided merely as a clarifying example shall not be construed as limiting the scope of the claims in any way.

The invention claimed is:

1. A decoder comprising:

a receiver for receiving an encoded data signal representing a plurality of audio signals, the encoded data signal comprising encoded time-frequency tiles for the plurality of audio signals, the encoded time-frequency tiles comprising non-downmix time-frequency tiles and downmix time-frequency tiles, each downmix time-frequency tile being a downmix of at least two time-frequency tiles of the plurality of audio signals and each non-downmix time-frequency tile representing only one time-frequency tile of the plurality of audio signals, and the allocation of the encoded time frequency tiles as downmix-time frequency tiles or non-time frequency tiles reflecting spatial characteristics of the time frequency tiles, the encoded data signal further comprising a downmix indication for time-frequency tiles of the plurality of audio signals, the downmix indication indicating whether time-frequency tiles of the plurality of audio signals are encoded as downmix time-frequency tiles or non-downmix time-frequency tiles;

a generator for generating a set of output signals from the encoded time-frequency tiles, the generation of the output signals comprising an upmixing for encoded time-frequency tiles that are indicated by the downmix indication to be downmix time-frequency tiles;

wherein at least one audio signal of the plurality of audio signals is represented by two downmix time-frequency tiles being downmixes of different sets of audio signals of the plurality of audio signals; and at least one downmix time-frequency tile is a downmix of an audio object not being associated with a nominal sound source position of a sound source rendering configuration and an audio channel being associated with a nominal sound source position of a sound source rendering configuration.

2. The decoder of claim 1 wherein the encoded data signal furthermore comprises parametric upmix data, and wherein the generator is arranged to adapt the upmixing operation in response to the parametric data.

3. The decoder of claim 1 wherein the generator comprises a rendering unit arranged to map time-frequency tiles for the plurality of audio signals to output signals corresponding to a spatial sound source configuration.

4. The decoder of claim 1 wherein the generator is arranged to generate time-frequency tiles for the set of output signals by applying matrix operations to the encoded time-frequency tiles, coefficients of matrix operations including upmix components for encoded time-frequency tiles for which the downmix indication indicates that the encoded time-frequency tile is a downmix time-frequency tile and not for encoded time-frequency tiles for which the downmix indication indicates that the encoded time-frequency tile is a non-downmix time-frequency tile.

5. The decoder of claim 1 wherein at least one audio signal is represented in the decoded signal by at least one non-downmix time-frequency tile and at least one downmix time-frequency tile.

6. The decoder of claim 1 wherein the downmix indication for at least one downmix time-frequency tile comprises a link between an encoded downmix time-frequency tile and a time-frequency tile of the plurality of audio signals.

7. The decoder of claim 1 wherein at least one audio signal of the plurality of audio signals is represented by encoded time-frequency tiles that include at least one encoded time-frequency tile not being a non-downmix time-frequency tile or a downmix time-frequency tile.

8. The decoder of claim 1 wherein at least some of the non-downmix time-frequency tiles are waveform encoded.

9. The decoder of claim 1 wherein at least some of the downmix time-frequency tiles are waveform encoded.

10. The decoder of claim 1 wherein the generator is arranged to upmix the downmix frequency tiles to generate upmixed time-frequency tiles for at least one of the plurality of audio signals of a downmix time-frequency tile; and the generator is arranged to generate time-frequency tiles for the set of output signals using the upmixed time-frequency tiles for tiles for which the downmix indication indicates that the encoded time-frequency tile is a downmix time-frequency tile.

11. A method of decoding comprising:

receiving an encoded data signal representing a plurality of audio signals, the encoded data signal comprising encoded time-frequency tiles for the plurality of audio signals, the encoded time-frequency tiles comprising non-downmix time-frequency tiles and downmix time-frequency tiles, each downmix time-frequency tile being a downmix of at least two time-frequency tiles of the plurality of audio signals and each non-downmix time-frequency tile representing only one time-frequency tile of the plurality of audio signals, and the allocation of the encoded time frequency tiles as downmix-time frequency tiles or non-time frequency tiles reflecting spatial characteristics of the time frequency tiles, the encoded data signal further comprising a downmix indication for time-frequency tiles of the plurality of audio signals, the downmix indication indicating whether time-frequency tiles of the plurality of audio signals are encoded as downmix time-frequency tiles or non-downmix time-frequency tiles; and generating a set of output signals from the encoded time-frequency tiles, the generation of the output signals comprising an upmixing for encoded time-frequency tiles that are indicated by the downmix indication to be downmix time-frequency tiles; wherein at least one audio signal of the plurality of audio signals is represented by two downmix time-frequency tiles being downmixes of different sets of audio signals of the plurality of audio signals; and at least one downmix time-frequency tile is a downmix of an audio object not being associated with a nominal sound source position of a sound source rendering configuration and an audio channel being associated with a nominal sound source position of a sound source rendering configuration.

12. An encoder comprising a receiver for receiving a plurality of audio signals, each audio signal comprising a plurality of time-frequency tiles;

a selector for selecting a first subset of the plurality of time-frequency tiles to be downmixed;

a downmixer for downmixing time-frequency tiles of the first subset to generate downmixed time-frequency tiles;

a first encoder for generating downmix encoded time-frequency tiles by encoding the downmix time-frequency tiles;

a second encoder for generating non-downmix time-frequency tiles by encoding a second subset of the time-frequency tiles of the audio signals without downmixing of time-frequency tiles of the second subset;

a unit for generating a downmix indication indicating whether time-frequency tiles of the first subset and the second subset are encoded as downmix encoded time-frequency tiles or as non-downmix time-frequency tiles;

an output for generating an encoded audio signal representing the plurality of audio signals, the encoded audio signal comprising the non-downmix time-frequency tiles, the downmix encoded time-frequency tiles, and the downmix indication;

wherein the selector is arranged to select time-frequency tiles for the first subset in response to a spatial characteristic of the time-frequency tiles; at least one audio signal of the plurality of audio signals is represented by two downmix time-frequency tiles being downmixes of different sets of audio signals of the plurality of audio signals; and at least one downmix time-frequency tile is a downmix of an audio object not being associated with a nominal sound source position of a sound source rendering configuration and an audio channel being associated with a nominal sound source position of a sound source rendering configuration.

13. The encoder of claim 12 wherein the selector is arranged to select time-frequency tiles for the first subset in response to a target data rate for the encoded audio signal.

14. The encoder of claim 12 wherein the selector is arranged to select time-frequency tiles for the first subset in response to at least one of:

an energy of the time-frequency tiles; and a coherence characteristic between pairs of the time-frequency tiles.

15. A method of encoding comprising:

receiving a plurality of audio signals, each audio signal comprising a plurality of time-frequency tiles;

selecting a first subset of the plurality of time-frequency tiles to be downmixed;

downmixing time-frequency tiles of the first subset to generate downmixed time-frequency tiles;

generating downmix encoded time-frequency tiles by encoding the downmixed time-frequency tiles;

generating non-downmix time-frequency tiles by encoding a second subset of the time-frequency tiles of the audio signals without downmixing of time-frequency tiles of the second subset;

generating a downmix indication indicating whether time-frequency tiles of the first subset and the second subset are encoded as downmixed encoded time-frequency tiles or as non-downmix time-frequency tiles; and generating an encoded audio signal representing the plurality of audio signals, the encoded audio signal comprising the non-downmix time-frequency tiles, the downmix encoded time-frequency tiles, and the downmix indication; and wherein the selecting comprises selecting time-frequency tiles for the first subset in response to a spatial characteristic of the time-frequency tiles; at least one audio signal of the plurality of audio signals is represented by two downmix time-frequency tiles being downmixes of different sets of audio signals of the plurality of audio signals; and at least one downmix time-frequency tile is a downmix of an audio object not being associated with a nominal sound source position of a sound source rendering configuration and an audio channel being associated with a nominal sound source position of a sound source rendering configuration.

16. An encoding and decoding system comprising:

an encoder comprising a receiver for receiving a plurality of audio signals, each audio signal comprising a plurality of time-frequency tiles, a selector for selecting a first subset of the plurality of time-frequency tiles to be downmixed, a downmixer for downmixing time-frequency tiles of the first subset to generate downmixed time-frequency tiles, a first encoder for generating downmix encoded time-frequency tiles by encoding the downmix time-frequency tiles, a second encoder for generating non-downmix time-frequency tiles by encoding a second subset of the time-frequency tiles of the audio signals without downmixing of time-frequency tiles of the second subset, a unit for generating a downmix indication indicating whether time-frequency tiles of the first subset and the second subset are encoded as downmix encoded time-frequency tiles or as non-downmix time-frequency tiles, an output for generating an encoded audio signal representing the plurality of audio signals, the encoded audio signal comprising the non-downmix time-frequency tiles, the downmix encoded time-frequency tiles, and the downmix indication, wherein the selector is arranged to select time-frequency tiles for the first subset in response to a spatial characteristic of the time-frequency tiles, at least one audio signal of the plurality of audio signals is represented by two downmix time-frequency tiles being downmixes of different sets of audio signals of the plurality of audio signals, and at least one downmix time-frequency tile is a downmix of an audio object not being associated with a nominal sound source position of a sound source rendering configuration and an audio channel being associated with a nominal sound source position of a sound source rendering configuration; and a decoder comprising a receiver for receiving the encoded audio signal representing the plurality of audio signals, and a generator for generating a set of output signals from the encoded time-frequency tiles, the generation of the output signals comprising an upmixing for encoded time-frequency tiles that are indicated by the downmix indication to be downmix time-frequency tiles.

* * * * *